US012029281B2

(12) United States Patent
Kanematsu et al.

(10) Patent No.: US 12,029,281 B2
(45) Date of Patent: Jul. 9, 2024

(54) SHOE LAST

(71) Applicant: ASICS CORPORATION, Kobe (JP)

(72) Inventors: Kei Kanematsu, Kobe (JP); Yuya Kozuka, Kobe (JP); Genki Hatano, Kobe (JP)

(73) Assignee: ASICS CORPORATION, Kobe (JP)

( * ) Notice: Subject to any disclaimer, the term of this patent is extended or adjusted under 35 U.S.C. 154(b) by 1 day.

(21) Appl. No.: 18/048,651

(22) Filed: Oct. 21, 2022

(65) Prior Publication Data

US 2023/0129876 A1 Apr. 27, 2023

(30) Foreign Application Priority Data

Oct. 22, 2021 (JP) ..... 2021-173323

(51) Int. Cl.
*A43D 3/02* (2006.01)
*A43D 3/06* (2006.01)

(52) U.S. Cl.
CPC ..... *A43D 3/06* (2013.01); *A43D 3/027* (2013.01)

(58) Field of Classification Search
CPC ..... A43D 3/02; A43D 3/027; A43D 3/06
See application file for complete search history.

(56) References Cited

U.S. PATENT DOCUMENTS 1,995,482 A * 3/1935 Piautz ..... B65D 5/48038 217/30
2,805,432 A * 9/1957 Riggs ..... A43D 3/027 12/133 B
6,896,175 B2 * 5/2005 Duke ..... B65D 5/48038 229/120.36
11,547,181 B2 * 1/2023 Kozuka ..... A43D 1/04
2016/0206049 A1 7/2016 Kallayil
2018/0014609 A1 1/2018 Bruce et al.
2023/0128436 A1 * 4/2023 Kozuka ..... A43D 3/027 12/133 B
2023/0129876 A1 * 4/2023 Kanematsu ..... A43D 3/027 12/133 R

FOREIGN PATENT DOCUMENTS

CN 109732913 A 5/2019
FR 2865358 A1 * 7/2005 ..... A43D 3/1433

OTHER PUBLICATIONS

Translation of FR-2865358 (Year: 2005).*

* cited by examiner

*Primary Examiner* — Ted Kavanaugh
(74) *Attorney, Agent, or Firm* — Studebaker & Brackett PC

(57) ABSTRACT

A last includes a first part having a first plate-shaped portion and a second part having a second part-side receiving portion having a cutout shape. When the first plate-shaped portion is received in the second part-side receiving portion, the first part and the second part are assembled. The second part includes a second part-side engaging portion having a protruding shape on an inner side surface in a portion defining the second part-side receiving portion, and the first plate-shaped portion has a main surface with a first part-side to-be-engaged portion having a through hole shape or a recessed shape. When the first plate-shaped portion is inserted into the second part-side receiving portion, the first plate-shaped portion is fitted into the second part-side receiving portion, and the first part-side to-be-engaged portion is engaged by the second part-side engaging portion.

14 Claims, 18 Drawing Sheets

100A

SHOE LAST

This nonprovisional application is based on Japanese Patent Application No. 2021-173323 filed on Oct. 22, 2021 with the Japan Patent Office, the entire contents of which are hereby incorporated by reference.

BACKGROUND OF THE INVENTION

Field of the Invention

The present invention relates to a last for shoe upper forming, on which a shoe upper is overlaid to thereby allow forming of the shoe upper.

Description of the Background Art

When shoes are manufactured, generally, a last (a shoe last) for forming a shoe upper (hereinafter also simply referred to as an "upper") into a prescribed shape is used. The last has a surface including a forming surface, on which fabric or the like to be formed as an upper is overlaid, so that the upper is formed.

U.S. Patent Application Publication No. 2018/0014609 discloses manufacturing of shoes in a portable housing. U.S. Patent Application Publication No. 2016/0206049 discloses a last preform that can be reformed by shape-memory polymer. Chinese Patent No. 109732913 discloses manufacturing of a last by 3D printing.

SUMMARY OF THE INVENTION

If a last having a forming surface conforming to the shape of a wearer's foot can be easily fabricated, shoes excellently fitted to feet can be widely provided. As one method therefor, it is conceivable to manufacture a last by assembling a plurality of last forming parts including plate-shaped parts. For manufacturing a last by such a method, a plurality of last forming parts including plate-shaped parts need to be easily and reliably fixed to each other.

Thus, the present invention has been made in view of the above-described problems, and aims to allow easy and reliable fixing of plate-shaped parts in a last configured by combining a plurality of last forming parts including the plate-shaped parts.

A last according to the present invention is for forming a shoe upper and includes a plurality of last forming parts that are detachable. The last forming parts include a first part and a second part. At least one of the first part and the second part defines a forming surface for forming the shoe upper. The first part includes a first plate-shaped portion, and the second part includes a second part-side receiving portion having a cutout shape. When the first plate-shaped portion is received in the second part-side receiving portion, the first part and the second part are assembled. The second part includes a second part-side engaging portion having a protruding shape on an inner side surface in a portion defining the second part-side receiving portion, and the first plate-shaped portion has a main surface with a first part-side to-be-engaged portion having a through hole shape or a recessed shape. In the last according to the present invention, when the first plate-shaped portion is inserted into the second part-side receiving portion, the first plate-shaped portion is fitted into the second part-side receiving portion, and further, the first part-side to-be-engaged portion is engaged by the second part-side engaging portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
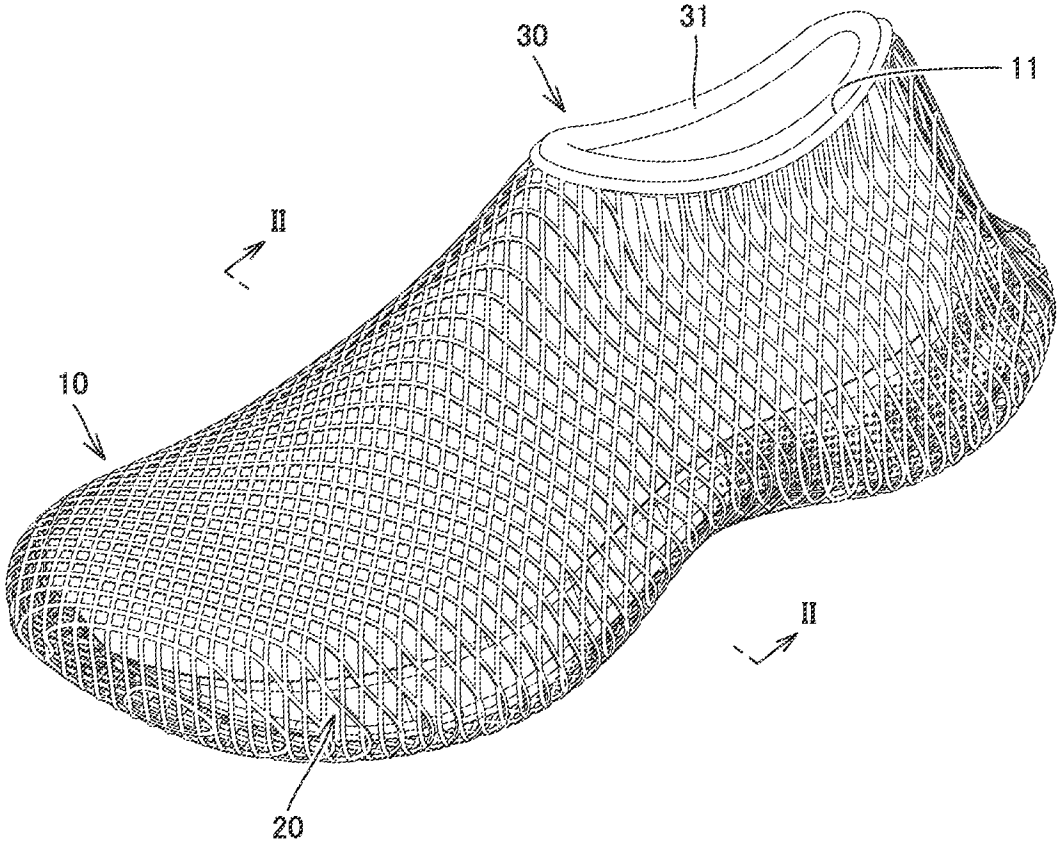
FIG. 1 is a perspective view showing an example of a shoe manufactured using a last according to a first embodiment.

In the following, embodiment of the present invention will be described in detail with reference to the accompanying drawings. In the embodiments described below, the same or corresponding portions are denoted by the same reference characters, and the description thereof will not be repeated. The following description includes terms such as a front-rear direction, a right-left direction, and an up-down direction. These terms referring to directions indicate the directions viewed from a wearer who wears shoes placed on a flat surface such as the ground. For example, the front side refers to a toe side while the rear side refers to a heel side.

First Embodiment

Figure 2:
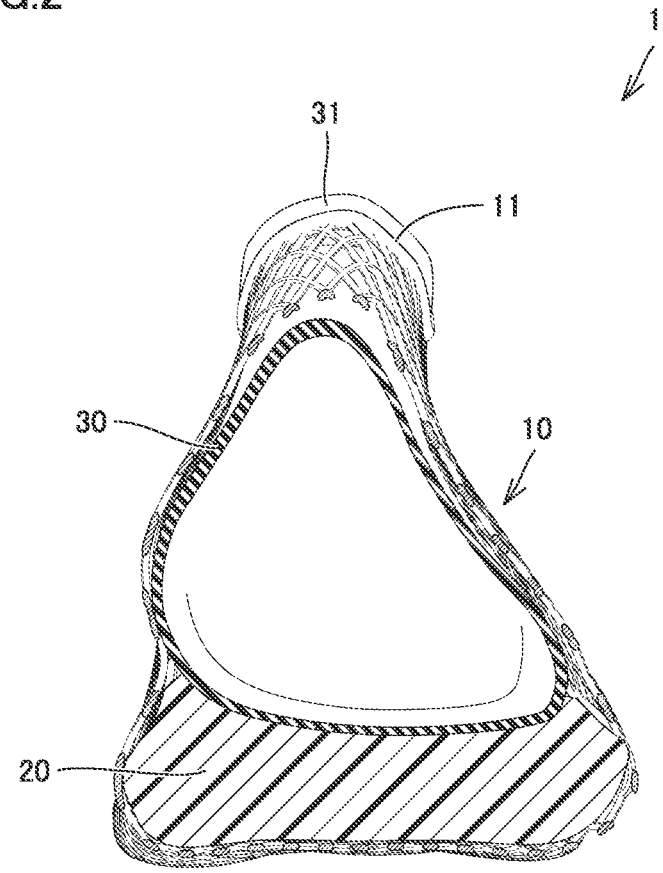
FIG. 2 is a cross-sectional view of the shoe shown in FIG. 1.
Figure 3:
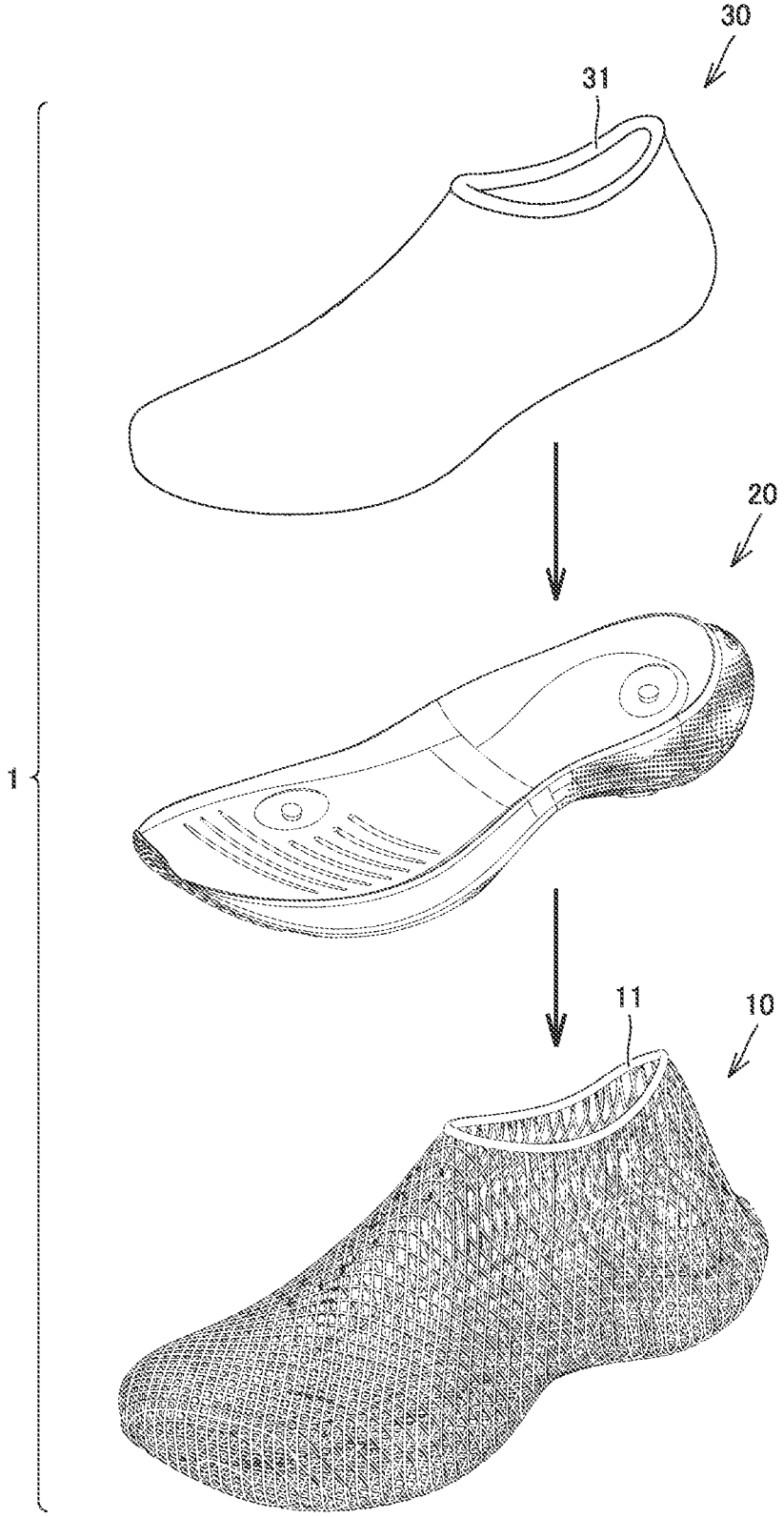
FIG. 3 is an exploded perspective view of the shoe shown in FIG. 1.

FIG. 1 is a perspective view showing an example of a shoe manufactured using a last according to the first embodiment. FIG. 2 is a cross-sectional view taken along a line II-II shown in FIG. 1. FIG. 3 is an exploded perspective view of the shoe shown in FIG. 1. Before explaining a last according to the present embodiment, a shoe 1 manufactured using the last will be first described with reference to FIGS. 1 to 3.

As shown in FIGS. 1 to 3, the shoe 1 is formed in a sock shape that substantially entirely covers a foot (i.e., a portion extending from an ankle to a distal end) of a wearer, and includes a shell 10, a sole 20, and an upper 30. Along an upper portion of the shoe 1, a topline 31 is provided through which a foot is inserted. Inside the shoe 1, a space is provided in which a wearer's foot is inserted when the wearer wears the shoe 1.

In the shoe 1, the sole 20 is accommodated in the shell 10, and the upper 30 is accommodated in the shell 10 to be located on the sole 20. Thereby, the sole 20 is sandwiched between the shell 10 and the upper 30.

The shell 10 constitutes an outermost shell of the shoe 1 and is formed of a single flexible member having a bag shape. The shell 10 has an upper end provided with an opening 11. The shell 10 covers a bottom surface and a circumferential surface of the sole 20 and a surface of the upper 30. The outer surface of the bottom of the shell 10 constitutes a ground contact surface of the shoe 1.

The shell 10 may be basically made of any material as long as it has flexibility, but preferably has appropriate strength. From this viewpoint, the shell 10 is preferably made of a resin material or a rubber material. Further, the shell 10 can be fabricated, for example, by injection molding, cast molding, or molding using a three-dimensional additive manufacturing apparatus. In particular, fabricating the shell 10 by molding using such a three-dimensional additive manufacturing apparatus makes it possible to fabricate shells 10 having a wide variety of structures that are difficult to be fabricated by injection molding or cast molding.

The sole 20 is a portion of the shoe 1 that supports a foot sole of a wearer, and is formed of an elastically-deformable flat member. The sole 20 is disposed in the space provided inside the shell 10 to be located in a lower space close to the ground contact surface.

The sole 20 may basically be made of any material as long as it is elastically deformable but is preferably formed of a member having suitable strength while maintaining excellent cushioning. From this viewpoint, the sole 20 is made using, for example, a resin-made foam material containing: a resin material as a main component; and a foaming agent and a cross-linking agent as sub-components. Alternatively, the sole 20 may be made using a rubber-made foam material containing: a rubber material as a main component; and a plasticizer, a foaming agent, a reinforcing agent, and a cross-linking agent as sub-components.

The upper 30 is a portion of the shoe 1 that comes into contact with the wearer's foot, and is formed of a flexibly deformable member having a bag shape. The upper 30 is disposed in the space provided inside the shell 10 to be located in an upper space close to the opening 11. Further, an upper end of the upper 30 is located so as to protrude outward from the opening 11, and a portion of the upper 30 that protrudes from the opening 11 forms the above-mentioned topline 31.

The upper 30 may basically be formed of any material as long as it is flexibly deformable, but is preferably made using woven fabric, knitted fabric, nonwoven fabric, synthetic leather, resin, or the like. In particular, as described later, by using woven fabric, knitted fabric, nonwoven fabric, or the like made of synthetic fibers having heat shrinkability, the upper that is more excellently fitted to the wearer's foot can be produced. Examples of synthetic fibers having heat shrinkability include those containing polyester, polyurethane, or the like as a main component.

In other words, in the case where the upper 30 is formed of woven fabric, knitted fabric, nonwoven fabric, or the like made of synthetic fibers having heat shrinkability, the upper 30 is formed in a bag shape in advance, into which a last (described later) is inserted and then subjected to a heat treatment. Due to heating, the upper 30 is thermally shrunk, so that the upper 30 is changed in shape and comes into close contact with the forming surface of the last, and then, this changed shape is maintained. Accordingly, a last conforming to the shape of the wearer's foot is prepared and used to form the upper 30 as described above, and thereby, the upper 30 fitted to the wearer's foot can be fabricated. Further, when the above-mentioned heat treatment is performed together with the last in the state in which the upper 30 is assembled in the shell 10, the upper 30 is fitted also to the shell 10, which allows a further improved fit.

Figure 4:
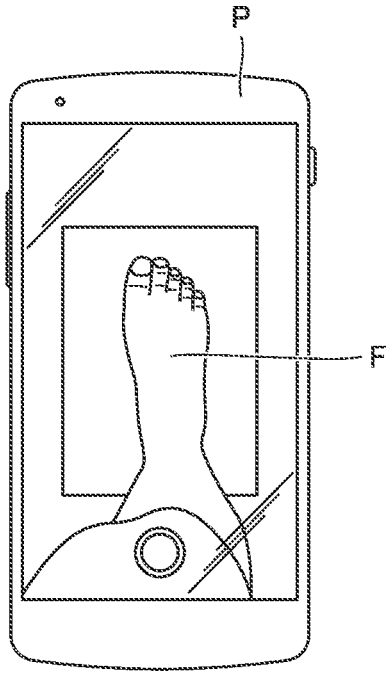
FIG. 4 is a diagram showing a state in which a wearer's foot is photographed in order to obtain a foot model.
Figure 5:
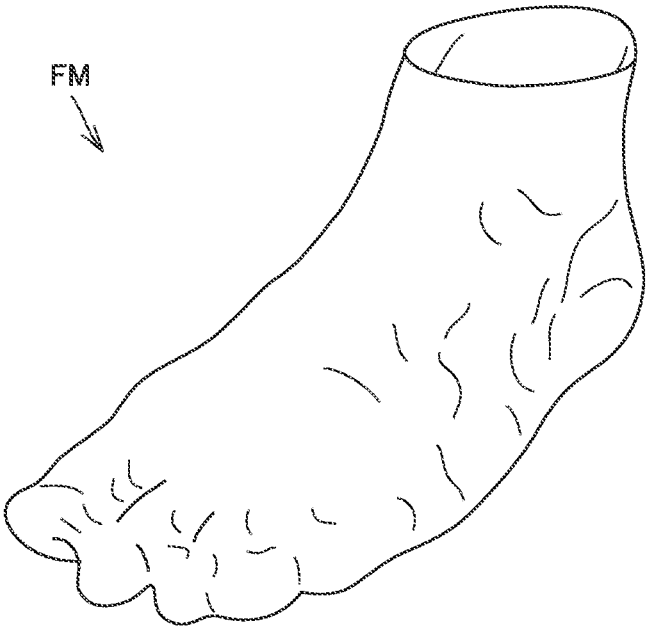
FIG. 5 is a perspective view of the foot model.
Figure 6:
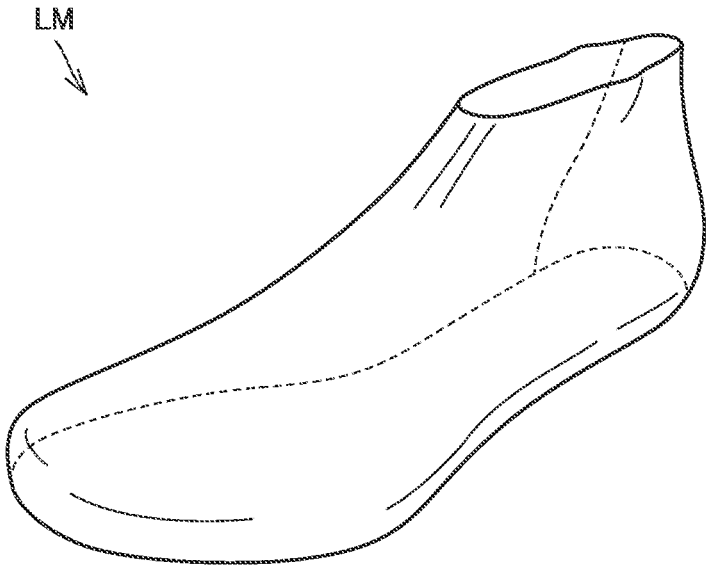
FIG. 6 is a perspective view of a last model produced based on the foot model.

FIG. 4 is a diagram showing the state in which a wearer's foot is photographed in order to obtain a foot model. FIG. 5 is a perspective view of the foot model. FIG. 6 is a perspective view of a last model produced based on the foot model. Referring to FIGS. 4 to 6, the following describes an example of a method of producing a last model in the case of manufacturing a last conforming to the shape of a wearer's foot.

As shown in FIG. 4, when the last model is produced, a foot F of a wearer is first photographed by a portable terminal such as a smartphone P or a digital camera capable of taking pictures, and then, image data of the foot F is obtained. The image data of the foot F may be obtained by taking pictures in a store visited by the wearer. The store may be a brick-and-mortar (physical) store or a mobile store such as an automobile and a trailer. Further, the image data of the foot F may be obtained by taking pictures in the wearer's house. In this case, for example, the image data of the foot F obtained by taking pictures by the wearer is transmitted to a server of a shoe manufacturer.

As shown in FIG. 5, a foot model FM is a three-dimensional model produced based on the measurement data of each part of the wearer's foot F, which is obtained from the image data of the foot F. For example, when the wearer's foot F is photographed by the smartphone P, the foot model FM can be produced based on the image data by software installed in advance in the smartphone P. Further, the foot model FM may also be produced by performing computations using both the data of the captured image and the data in a server used by the shoe manufacturer.

The foot model FM may be formed in the same shape as the shape of the wearer's foot F. Also, for design or functional reasons, a specific part of the foot model FM may be corrected by desired dimensions with respect to the shape of the wearer's foot F.

As shown in FIG. 6, a last model LM is a model produced based on the foot model FM shown in FIG. 5 and customized to conform to the shape of the wearer's foot F. By fabricating a last based on this last model LM, the last conforming to the shape of the wearer's foot can be manufactured.

Figure 7:
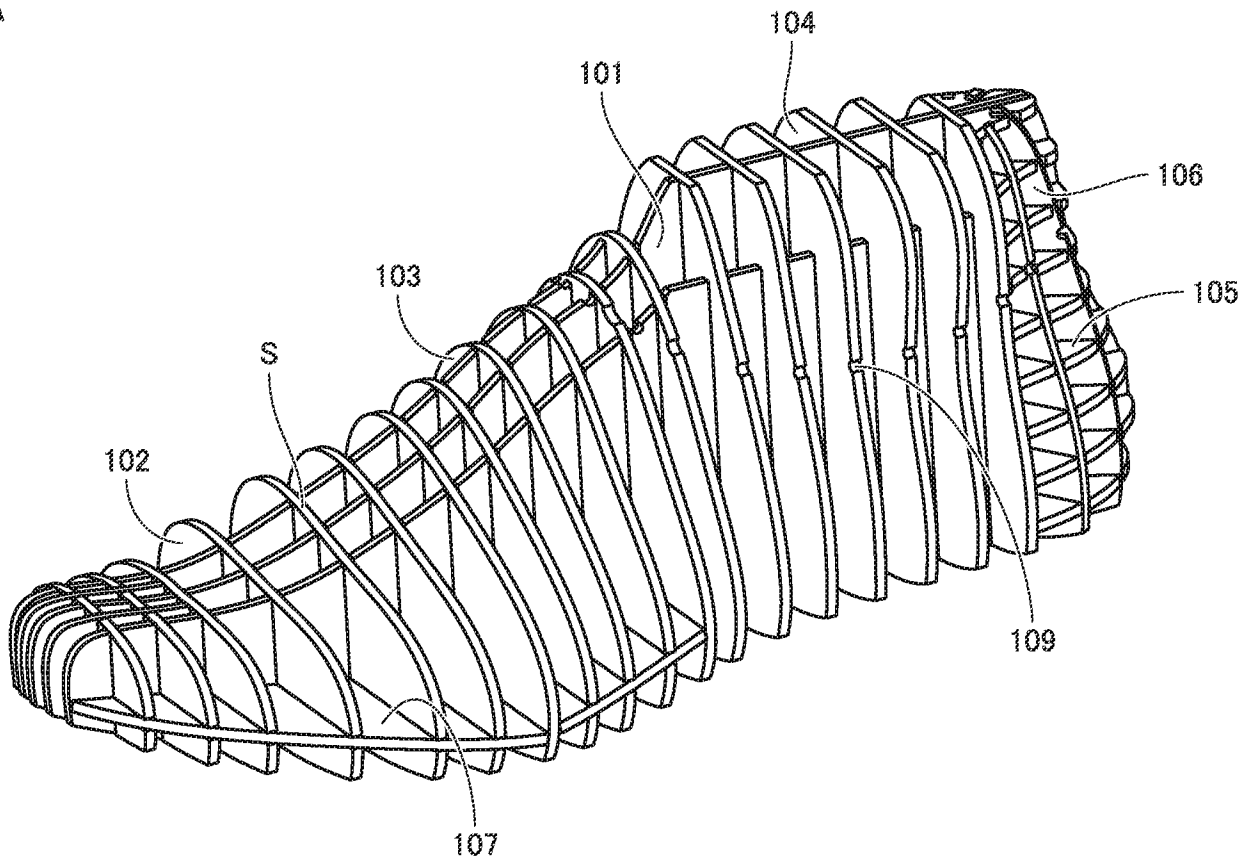
FIG. 7 is a perspective view of the last according to the first embodiment.

FIG. 7 is a perspective view of the last according to the present embodiment. Referring to FIG. 7, the configuration of a last 100A according to the present embodiment will be hereinafter described. Note that the last 100A according to the present embodiment is fabricated based on the above-described method of producing a last model and conforms to the shape of a wearer's foot.

As shown in FIG. 7, the last 100A is formed by combining a plurality of detachable plate-shaped parts. The plurality of plate-shaped parts include a plurality of foot length direction parts 101, a plurality of toe parts 102, a plurality of instep parts 103, a plurality of ankle parts 104, a plurality of circumferential heel parts 105, a plurality of vertical heel parts 106, and a plurality of laterally extending parts 107.

Each of the plurality of foot length direction parts 101 is formed of a plate-shaped part extending in the front-rear direction (i.e., the foot length direction) and the up-down direction (i.e., the direction orthogonal to both the foot length direction and the foot width direction). The plurality of foot length direction parts 101 include two types of parts including longer parts and shorter parts (see FIG. 8). The longer parts of the plurality of foot length direction parts 101 are used as a base frame of the last 100A, and disposed to extend in the front-rear direction at a substantially central portion in the right-left direction (i.e., the foot width direction). Each of the shorter parts of the plurality of foot length direction parts 101 is disposed at a position corresponding to the front end of the wearer's toe.

Each of the plurality of toe parts 102 is formed of a plate-shaped part extending in the right-left direction and the up-down direction. The plurality of toe parts 102 each are disposed at a position corresponding to the wearer's toe and are assembled into the plurality of foot length direction parts 101.

Each of the plurality of instep parts 103 is formed of a plate-shaped part extending in the right-left direction and the up-down direction. The plurality of instep parts 103 each are disposed at a position corresponding to the wearer's instep, and are assembled into the plurality of foot length direction parts 101.

Each of the plurality of ankle parts 104 is formed of a plate-shaped part extending in the right-left direction and the up-down direction. The plurality of ankle parts 104 each are disposed at a position corresponding to the wearer's ankle, and are assembled into the plurality of foot length direction parts 101.

Each of the plurality of circumferential heel parts 105 is formed of a plate-shaped part extending in the front-rear direction and the right-left direction. The plurality of circumferential heel parts 105 each are disposed at a position corresponding to the wearer's heel, and are assembled into the plurality of foot length direction parts 101.

Each of the plurality of vertical heel parts 106 is formed of a plate-shaped part extending in the up-down direction. The plurality of vertical heel parts 106 are arranged radially in a range of approximately 180° around an axis extending in the up-down direction. The plurality of vertical heel parts 106 each are disposed at a position corresponding to the wearer's heel, and are assembled into the plurality of circumferential heel parts 105.

Each of the plurality of laterally extending parts 107 is formed of a plate-shaped part extending in the front-rear direction and the right-left direction. The plurality of laterally extending parts 107 each are disposed at a position corresponding to the wearer's toe and instep, and are assembled into the plurality of toe parts 102 and the plurality of instep parts 103.

In the state in which the plurality of foot length direction parts 101, the plurality of toe parts 102, the plurality of instep parts 103, the plurality of ankle parts 104, the plurality of circumferential heel parts 105, the plurality of vertical heel parts 106, and the plurality of laterally extending parts 107 are combined with each other, the end surfaces of these parts (i.e., the surfaces extending in the thickness direction of these plate-shaped parts) define a forming surface S of the last 100A. Then, an upper yet to be formed (hereinafter also referred to as an upper forming material) is overlaid to cover the forming surface S, and thereby, the upper 30 is formed.

Specifically, when the upper 30 is formed, the upper forming material is overlaid on the last 100A so as to cover the forming surface S as described above, which is then subjected to a heat treatment. As described above, particularly when the upper 30 is formed of woven fabric, knitted fabric, nonwoven fabric, or the like made of synthetic fibers having heat shrinkability, the heat shrinking yarns contained in the upper 30 shrink due to this heat treatment, with the result that the upper 30 is fabricated along the forming surface S of the last 100A.

In this case, a slit having a cutout shape, an engaging portion having a protruding shape, and a to-be-engaged portion having a through hole shape are provided at prescribed positions in each of the plurality of plate-shaped parts. The slit, the engaging portion, and the to-be-engaged portion serve as assembly sections when the plurality of plate-shaped parts are assembled together, which will be described later in detail.

Further, a recessed portion 109 is provided in each of portions of the last 100A that correspond to the topline 31 (see FIG. 1 and the like) of the shoe 1 to be manufactured. Specifically, the recessed portions 109 each are formed by cutting out a part of an end portion of each part disposed at a position corresponding to the topline 31, and are provided entirely in a loop shape. More specifically, the recessed portion 109 is provided in each of: the longer parts of the foot length direction parts 101; the ankle parts 104; some of the circumferential heel parts 105; and the vertical heel parts 106.

The recessed portion 109 provided at each position corresponding to the topline 31 can be used as an indicator for positioning the upper end portion of the upper forming material (i.e., the portion to be formed as the topline 31) when the upper 30 is formed, or can be used as a part over which the upper end portion of the upper forming material is hooked for preventing positional displacement.

The plurality of foot length direction parts 101, the plurality of toe parts 102, the plurality of instep parts 103, the plurality of ankle parts 104, the plurality of circumferential heel parts 105, the plurality of vertical heel parts 106, and the plurality of laterally extending parts 107 each are formed of a wooden board, and more specifically, are cut out from wooden boards B1 and B2 as materials (see FIGS. 8 and 9), which will be described later.

Figure 8:
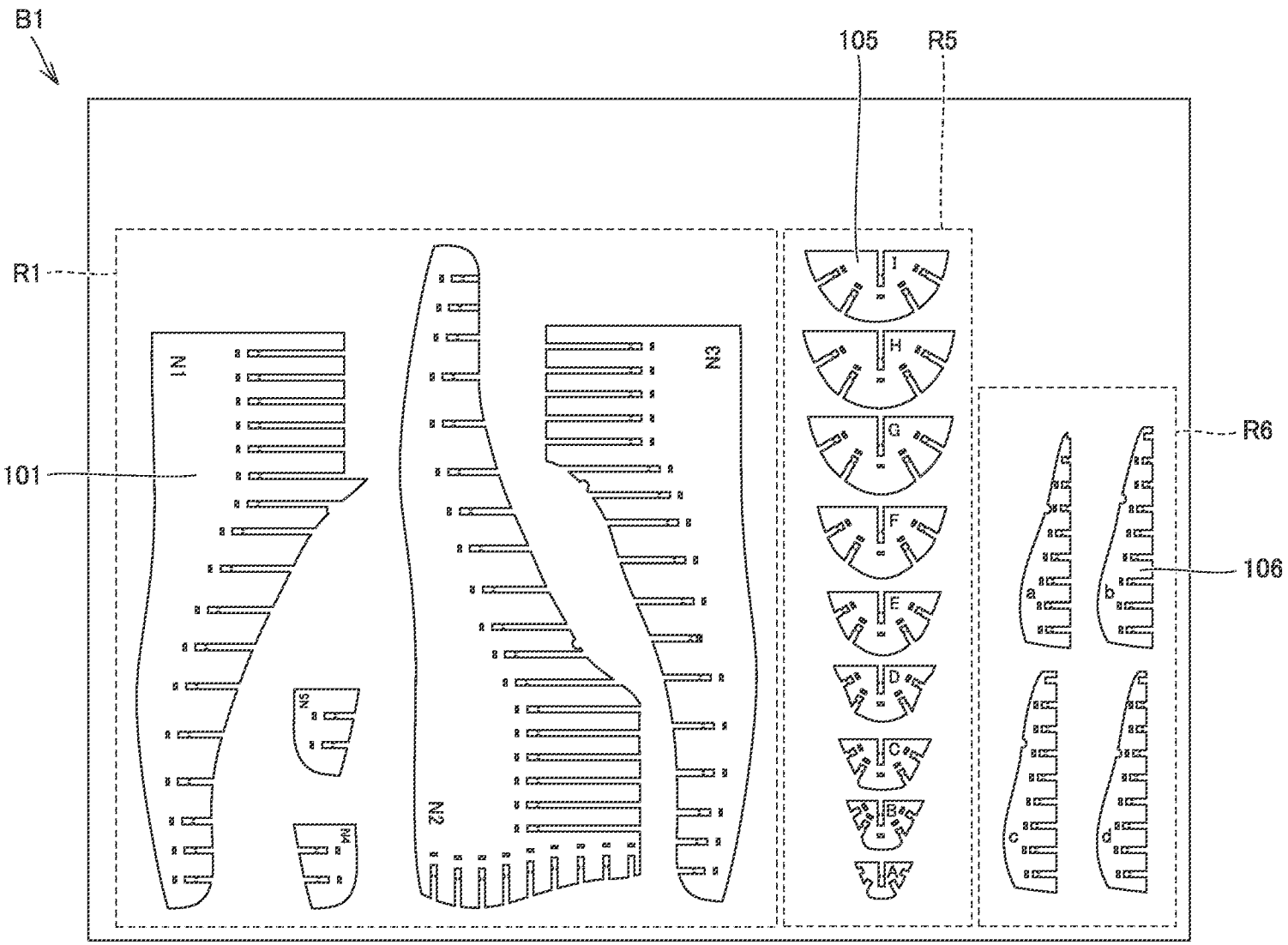
FIG. 8 is a plan view showing, in a visualized manner, a cutting pattern of a wooden board from which some of a plurality of plate-shaped parts included in the last shown in FIG. 7 are cut out.
Figure 9:
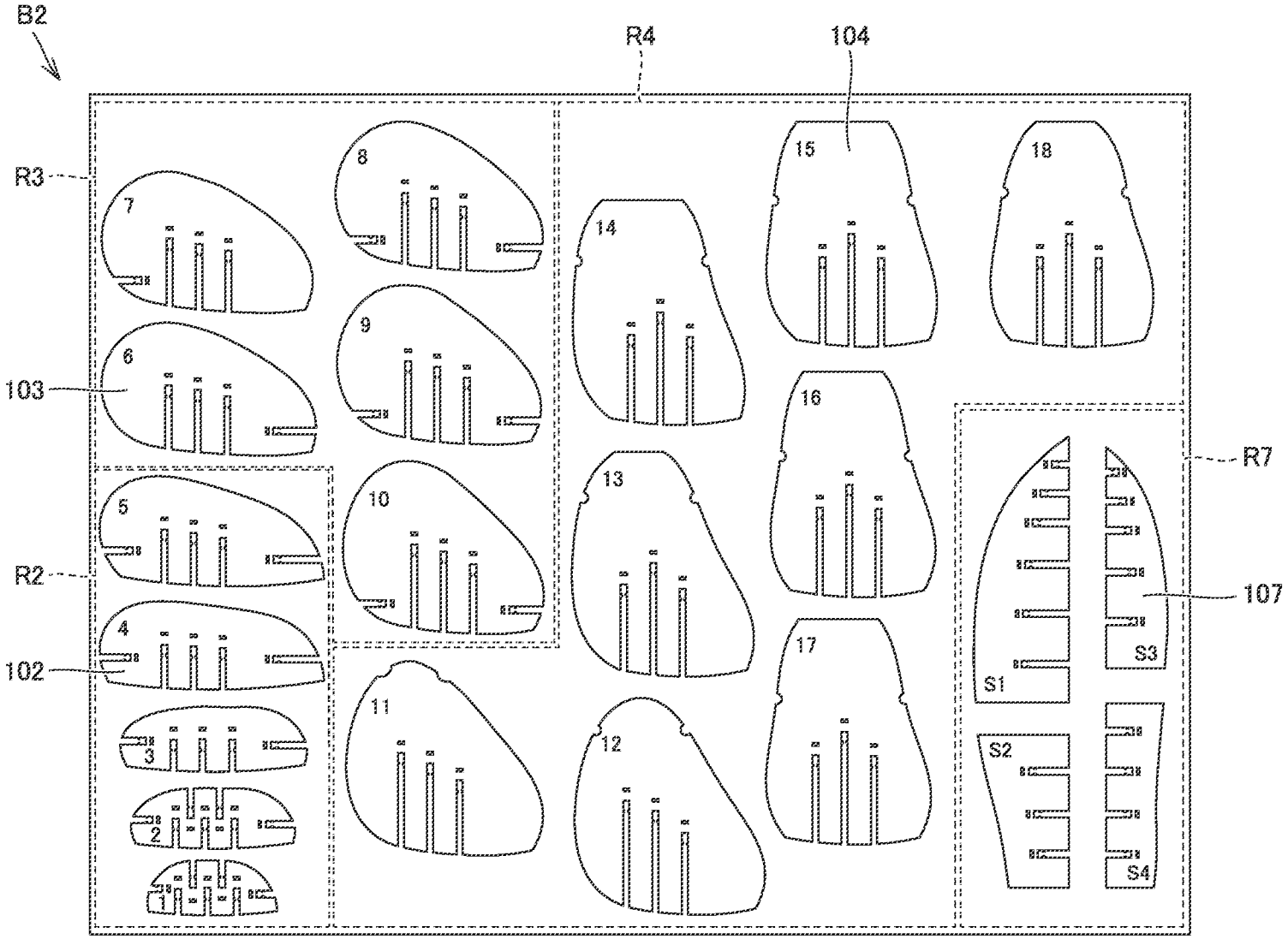
FIG. 9 is a plan view showing, in a visualized manner, a cutting pattern of the wooden board from which the remaining plate-shaped parts included in the last shown in FIG. 7 are cut out.

FIG. 8 is a plan view showing, in a visualized manner, a cutting pattern of a wooden board from which some of the plurality of plate-shaped parts included in the last shown in FIG. 7 are cut out. FIG. 9 is a plan view showing, in a visualized manner, a cutting pattern of the wooden board from which the remaining plate-shaped parts included in the last shown in FIG. 7 are cut out. Referring to FIGS. 8 and 9, the following describes the wooden boards B1 and B2 from which a plurality of plate-shaped parts are cut out.

As shown in FIG. 8, among the above-mentioned plurality of plate-shaped parts, the plurality of foot length direction parts 101, the plurality of circumferential heel parts 105, and the plurality of vertical heel parts 106 are arranged in the wooden board B1. The plurality of foot length direction parts 101, the plurality of circumferential heel parts 105, and the plurality of vertical heel parts 106 are arranged side by side in regions R1, R5, and R6, respectively, defined on the wooden board B1.

As shown in FIG. 9, among the above-mentioned plurality of plate-shaped parts, the plurality of toe parts 102, the plurality of instep parts 103, the plurality of ankle parts 104, and the plurality of laterally extending parts 107 are arranged in the wooden board B2. The plurality of toe parts 102, the plurality of instep parts 103, the plurality of ankle parts 104, and the plurality of laterally extending parts 107 are arranged side by side in regions R2, R3, R4, and R7, respectively, defined on the wooden board B2.

In this case, the wooden boards B1 and B2 are cut, for example, by laser irradiation. By cutting the wooden boards B1 and B2 by such laser irradiation, a plurality of plate-shaped parts can be cut out speedily and accurately. Further, in the case of cutting the wooden boards by laser irradiation, by changing the conditions of laser irradiation, each of the plate-shaped parts to be cut out can be engraved with numerals, alphabets and the like (see FIG. 8 and FIG. 9), which can be used as indicators for assembling the plurality of plate-shaped parts. Note that the method of cutting the wooden boards is not limited to the above-described method, but the wooden boards may be cut with a metal blade, water sprayed with high pressure, or the like.

Further, generation of waste materials can be significantly suppressed by producing the cutting patterns under the condition that the areas of the regions R1 to R7 in which the plate-shaped parts are arranged are minimized in the wooden boards B1 and B2. For example, when standard shoes are manufactured, the cutting patterns are produced so as to satisfy the above-mentioned condition, and thereby, each of the wooden boards B1 and B2 can be reduced in size to 300 mm×450 mm.

As the wooden boards B1 and B2, a medium-density fiberboard (MDF) can be suitably used. The wooden boards B1 and B2 are not limited to such an MDF, but may be an insulation fiberboard (IB), a hard fiberboard (HB), and the like. As an IB, a class-A IB, a tatami board, a sheathing board, and the like can be used. Further, as an HB, a standard board, a tempered board, and the like can be used. Further, in place of the wooden boards B1 and B2, boards made of various materials such as a highly recyclable cardboard, cork, metal, and thermoplastic resin can also be used.

Figure 10:
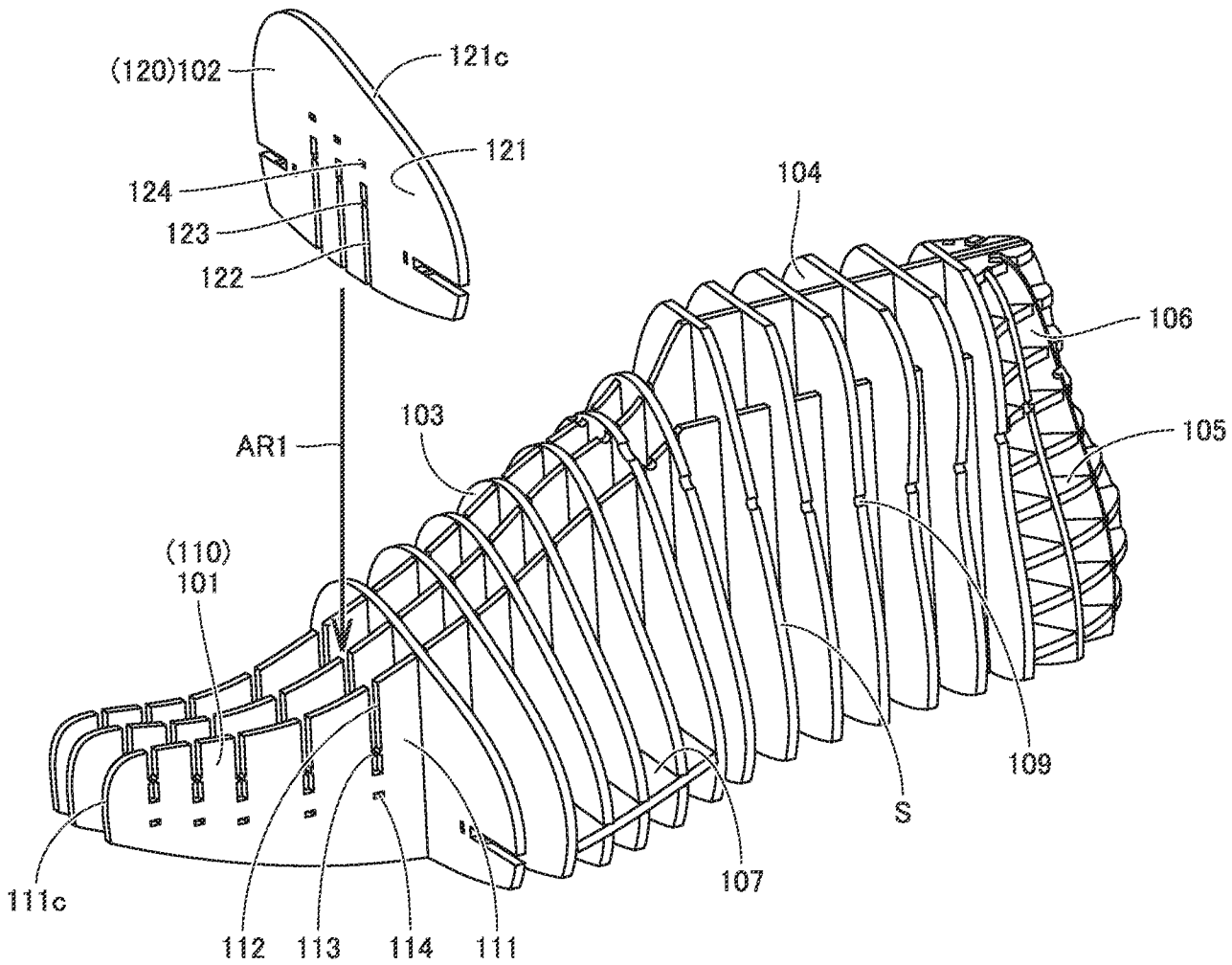
FIG. 10 is a perspective view showing an assembly method for the last shown in FIG. 7.

FIG. 10 is a perspective view showing an assembly method for the last shown in FIG. 7. Referring to FIG. 10, the assembly method for the last 100A according to the present embodiment will be hereinafter described.

As shown in FIG. 10, for assembling the last 100A, a plurality of plate-shaped parts are assembled so as to be sequentially engaged with each other. In the last 100A according to the present embodiment, for example, the plurality of ankle parts 104 are assembled into the longer parts of the plurality of foot length direction parts 101, into which the plate-shaped parts including the plurality of circumferential heel parts 105, the plurality of vertical heel parts 106, the plurality of instep parts 103, the plurality of toe parts 102, the plurality of laterally extending parts 107, and the plurality of foot length direction parts 101 are assembled in ascending order of length.

Thereby, the last 100A shown in FIG. 7 is assembled. In this case, FIG. 10 exemplarily illustrates the state in the middle of assembly and shows the step of assembling one of the plurality of toe parts 102 into the plurality of foot length direction parts 101. Note that the above-described order of assembly is merely by way of example, and the order of assembly can be changed as appropriate.

The plate-shaped parts are assembled using the slits each having a cutout shape, the engaging portions each having a protruding shape, and the to-be-engaged portions each having a through hole shape that are provided as the above-mentioned assembly sections in the respective plate-shaped parts. Specifically, as shown in FIG. 10, for example, in the step of assembling one of the plurality of toe parts 102 into the plurality of foot length direction parts 101, a slit, an engaging portion, and a to-be-engaged portion provided in each of the foot length direction parts 101, and a plurality of slits, a plurality of engaging portions, and a plurality of to-be-engaged portions provided in one of the toe parts 102 are used.

Figure 11:
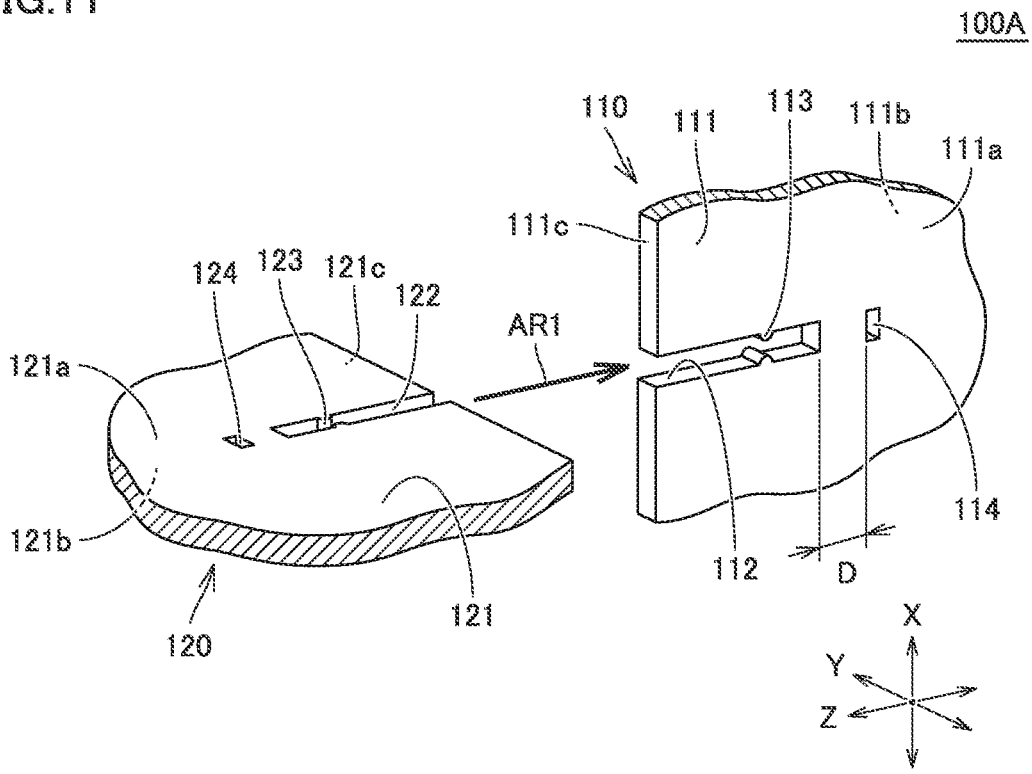
FIG. 11 is a partially cutaway perspective view for illustrating an assembly structure of the plate-shaped parts in the last shown in FIG. 7.
Figure 12:
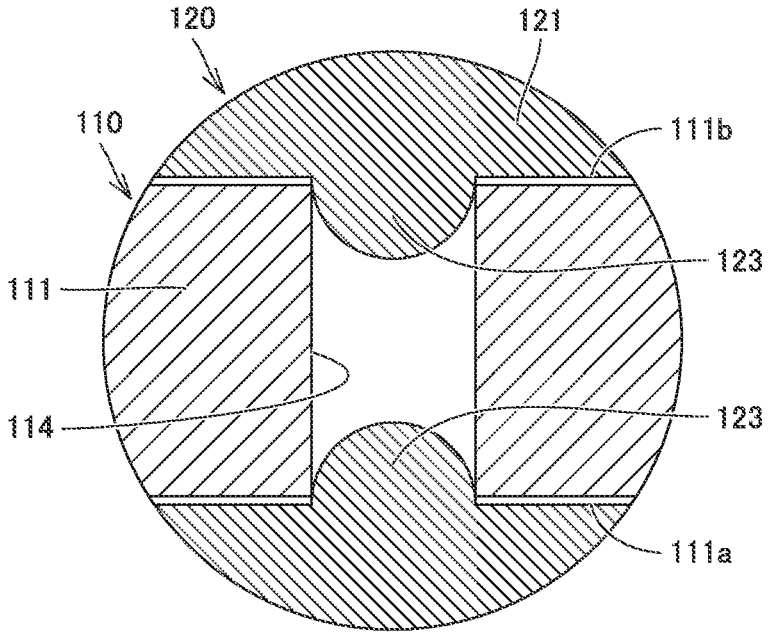
FIG. 12 is a schematic cross-sectional view for illustrating the assembly structure of the plate-shaped parts in the last shown in FIG. 7.

For more specifically explaining the above-described configuration, the following description refers to FIGS. 11 and 12 in addition to the above-mentioned FIG. 10. FIGS. 11 and 12 are a partially cutaway perspective view and a schematic cross-sectional view, respectively, for illustrating the assembly structure of the plate-shaped parts in the last shown in FIG. 7. Note that FIG. 11 shows the state before assembly, and FIG. 12 shows the state after assembly.

In order to facilitate understanding, the following description is given while focusing on the assembly section of one of the above-mentioned plurality of foot length direction parts 101 and the above-mentioned one toe part 102. In the following description, one of the plurality of foot length direction parts 101 is defined as a first part 110 and one toe part 102 is defined as a second part 120.

As shown in FIGS. 10 and 11, the first part 110 includes a first plate-shaped portion 111 having a pair of main surfaces 111*a* and 111*b* and an end surface 111*c*. The first plate-shaped portion 111 is provided with a slit 112 that is a first part-side slit serving as a first part-side receiving portion, a pair of engaging portions 113 each serving as a first part-side engaging portion, and a to-be-engaged portion 114 serving as a first part-side to-be-engaged portion.

The slit 112 is formed in a cutout shape linearly extending so as to reach the end surface 111*c* of the first plate-shaped portion 111. The pair of engaging portions 113 are provided on the inner side surfaces of the first plate-shaped portion 111 in a portion defining the slit 112. Each of the pair of engaging portions 113 has a protruding shape. One and the other of the pair of engaging portions 113 are provided on one and the other of the pair of inner side surfaces such that the pair of engaging portions 113 face each other in the direction intersecting with the extending direction of the slit 112. The pair of engaging portions 113 each have a semi-cylindrical shape.

The to-be-engaged portion 114 is formed in a through hole shape, and provided in the first plate-shaped portion 111 so as to reach the pair of main surfaces 111*a* and 111*b* of the first plate-shaped portion 111. The to-be-engaged portion 114 is located on the line extending in the extending direction of the slit 112. The to-be-engaged portion 114 is rectangular in a plan view.

On the other hand, the second part 120 includes a second plate-shaped portion 121 having a pair of main surfaces 121*a* and 121*b* and an end surface 121*c*. The second plate-shaped portion 121 is provided with a slit 122 that is a second part-side slit serving as a second part-side receiving portion, a pair of engaging portions 123 each serving as a second part-side engaging portion, and a to-be-engaged portion 124 serving as a second part-side to-be-engaged portion.

The slit 122 is formed in a cutout shape linearly extending so as to reach the end surface 121*c* of the second plate-shaped portion 121. The pair of engaging portions 123 are provided on the inner side surfaces of the second plate-shaped portion 121 in a portion defining the slit 122. Each of the pair of engaging portions 123 has a protruding shape. One and the other of the pair of engaging portions 123 are provided on one and the other of the pair of inner side surfaces such that the pair of engaging portions 123 face each other in the direction intersecting with the extending direction of the slit 122. The pair of engaging portions 123 each have a semi-cylindrical shape.

The to-be-engaged portion 124 is formed in a through hole shape and provided in the second plate-shaped portion 121 so as to reach the pair of main surfaces 121*a* and 121*b* of the second plate-shaped portion 121. The to-be-engaged portion 124 is located on the line extending in the extending direction of the slit 122. The to-be-engaged portion 124 is rectangular in a plan view.

When the first part 110 and the second part 120 are assembled, the first plate-shaped portion 111 of the first part 110 and the second plate-shaped portion 121 of the second part 120 are directed so as to intersect with each other, and positioned such that the slit 122 provided in the second part 120 is located at a position corresponding to the slit 112 provided in the first part 110. Then, in this state, the second part 120 is pushed into the first part 110 in the direction indicated by an arrow AR1 shown in the figure.

Thereby, the first plate-shaped portion 111 of the first part 110 is received in the slit 122 provided in the second part 120, and the second plate-shaped portion 121 of the second part 120 is received in the slit 112 provided in the first part 110, with the result that the first plate-shaped portion 111 and the second plate-shaped portion 121 are engaged with each other.

At this time, the first plate-shaped portion 111 is inserted into the slit 122, and thereby, not only the first plate-shaped portion 111 is fitted into the slit 122, but also the pair of engaging portions 123 each having a protruding shape and provided in the second part 120 are further fitted into the to-be-engaged portion 114 having a through hole shape and provided in the first part 110 as shown in FIG. 12. Accordingly, the to-be-engaged portion 114 is engaged by the pair of engaging portions 123.

At this time, a portion of the to-be-engaged portion 114 that is exposed in one of the pair of main surfaces 111*a* and 111*b* of the first plate-shaped portion 111 is engaged by one of the pair of engaging portions 123, and a portion of the to-be-engaged portion 114 that is exposed in the other of the pair of main surfaces 111*a* and 111*b* of the first plate-shaped portion 111 is engaged by the other of the pair of engaging portions 123.

In addition, the second plate-shaped portion 121 is inserted into the slit 112, and thereby, not only the second plate-shaped portion 121 is fitted into the slit 112, but also the pair of engaging portions 113 each having a protruding shape and provided in the first part 110 are fitted into the to-be-engaged portion 124 having a through hole shape and provided in the second part 120 (not shown). Thus, the to-be-engaged portion 124 is engaged by the pair of engaging portions 113.

At this time, a portion of the to-be-engaged portion 124 that is exposed in one of the pair of main surfaces 121*a* and 121*b* of the second plate-shaped portion 121 is engaged by one of the pair of engaging portions 113, and a portion of the to-be-engaged portion 124 that is exposed in the other of the pair of main surfaces 121*a* and 121*b* of the second plate-shaped portion 121 is engaged by the other of the pair of engaging portions 113.

In addition, the first plate-shaped portion 111 and the second plate-shaped portion 121 may be fitted into the slit 122 and the slit 112, respectively, so as to be in close contact with each other, or so as to provide a slight clearance therebetween in order to facilitate insertion or in consideration of errors in dimensional accuracy.

By the configuration as described above, the first plate-shaped portion 111 is fitted into the slit 122, so that the first part 110 and the second part 120 are fixed in a Y-axis direction shown in FIG. 11, and the second plate-shaped portion 121 is fitted into the slit 112, so that the first part 110 and the second part 120 are fixed in an X-axis direction shown in FIG. 11. Also, the to-be-engaged portion 114 is engaged by the engaging portion 123, so that the first part 110 and the second part 120 are fixed in the X-axis direction and a Z-axis direction shown in FIG. 11, and the to-be-engaged portion 124 is engaged by the engaging portion 113, so that the first part 110 and the second part 120 are fixed in the Y-axis direction and the Z-axis direction shown in FIG. 11.

Thus, by employing the above-described configuration, the first part 110 and the second part 120 can be firmly fixed to each other in a simple operation of positioning the first part 110 and the second part 120 and then pushing the second part 120 into the first part 110. In the last 100A according to the present embodiment, the above-described assembly structure is applied to each of the assembly sections for all the plate-shaped parts included in the last 100A.

Therefore, according to the last 100A in the present embodiment, the plurality of plate-shaped parts included in the last 100A can be easily and reliably fixed, and the last having such mechanical strength as preventing easy disengagement of these plate-shaped parts can be speedily and simply fabricated.

The above-described example shows the operation of pushing the second part 120 into the first part 110, but the first part 110 may be pushed into the second part 120.

In the case of employing the above-described assembly structure in this case, when the second part 120 is pushed into the first part 110, the pair of engaging portions 123 provided in the second part 120 pass through the slit 112 provided in the first part 110, and thereafter, come into contact with a portion of the first plate-shaped portion 111 that is located between the slit 112 and the to-be-engaged portion 114 provided in the first part 110. At this time, the second part 120 is further pushed into the first part 110, and thereby, the second part 120 is elastically deformed such that the pair of engaging portions 123 open outward and then fit into the to-be-engaged portion 114.

Similarly, when the second part 120 is pushed into the first part 110, the pair of engaging portions 113 provided in the first part 110 pass through the slit 122 provided in the second part 120, and thereafter, come into contact with a portion of the second plate-shaped portion 121 that is located between the slit 122 and the to-be-engaged portion 124 provided in the second part 120. At this time, the second part 120 is further pushed into the first part 110, and thereby, the first part 110 is elastically deformed such that the pair of engaging portions 113 open outward and then fit into the to-be-engaged portion 124.

Thus, by employing the above-described configuration, completion of assembly of the first part 110 and the second part 120 is indicated by an impact transmitted to the fingers of a worker who performs the assembly operation. This allows the worker to obtain what is called a feeling of clicking, so that the worker can easily recognize that the assembly has completed. Therefore, employing the above-described configuration also contributes to convenience of the assembly operation.

As described above, the pair of engaging portions 113 and the pair of engaging portions 123 each have a semi-cylindrical shape. Accordingly, when the second part 120 is pushed into the first part 110, the frictional resistance generated therebetween can be reduced, so that the second part 120 can be pushed into the first part 110 with smaller force.

Referring to FIG. 11, a distance D between the slit 112 and the to-be-engaged portion 114 provided in the first part 110 (as well as the distance between the slit 122 and the to-be-engaged portion 124 provided in the second part 120) influences the workability during assembly and the fixability after assembly.

In other words, the larger distance D allows a smaller strain occurring when the first part 110 is elastically deformed such that the slit 112 is opened as described above. Accordingly, the first part 110 and the second part 120 can be assembled with smaller force, and thus, the workability is improved.

On the other hand, the smaller distance D allows a larger strain occurring when the first part 110 is elastically deformed such that the slit 112 is opened as described above. Accordingly, larger force is required for separating the first part 110 from the second part 120 that are fitted together, and thus, the fixability is further improved.

Based on the above-described viewpoint, the distance D preferably has an appropriate length for the purpose of achieving both the workability and the fixability, and, for example, set to be 5 mm or more and 12 mm or less.

In the above description about the example in the present embodiment, one and the other of the pair of engaging portions 113 provided in the first part 110 are provided on one and the other of the pair of inner side surfaces of the slit 112 such that the pair of engaging portions 113 face each other, and one and the other of the pair of engaging portions 123 provided in the second part 120 are provided on one and the other of the pair of inner side surfaces of the slit 122 such that the pair of engaging portions 123 face each other, but the above-described configuration is not necessarily required.

For example, one and the other of a pair of engaging portions may be provided on one and the other of a pair of inner side surfaces of the slit such that one engaging portion and the other engaging portion are displaced so as not to face each other. Alternatively, in place of providing one pair of engaging portions, one or more engaging portion may be provided on only one of the pair of inner side surfaces of the slit. Further, one or more engaging portions may be provided on one of the pair of inner side surfaces of the slit, and one or more engaging portions may be provided on the other of the pair of inner side surfaces of the slit. Also in this case, all or some of the engaging portions provided on one inner side surface may face the corresponding engaging portions provided on the other inner side surface, or all of the engaging portions provided on one inner side surface may not face the corresponding engaging portions provided on the other inner side surface.

In this way, the engaging portions 113 provided in the first part 110 and the engaging portions 123 provided in the second part 120 can be variously changed in number and installation position. In that case, however, the to-be-engaged portion 124 needs to be provided in the second part 120 so as to be equal in number and installation position to the engaging portion 113. Also, the to-be-engaged portion 114 needs to be provided in the first part 110 so as to be equal in number and installation position to the engaging portion 123.

Further, as described above, the last 100A according to the present embodiment can be speedily and simply fabricated, and therefore, for example, a wearer himself/herself can also experience such a speedy and simple fabrication. In other words, by way of example, the wearer himself/herself can also experience the operation of photographing the wearer's foot F in a store visited by the wearer to obtain image data, producing the last model LM based on the image data, fabricating a plurality of plate-shaped parts based on the last model LM, and then, by the wearer himself/herself, assembling the plurality of plate-shaped parts to fabricate the last 100A.

First to Sixth Modifications

FIGS. 13A to 13F each are a schematic cross-sectional view for illustrating an assembly structure of plate-shaped parts in a last according to a corresponding one of the first to sixth modifications. Referring to FIGS. 13A to 13F, the following describes lasts 100A1 to 100A6 according to the first to sixth modifications based on the above-described first embodiment.

Figure 13A:
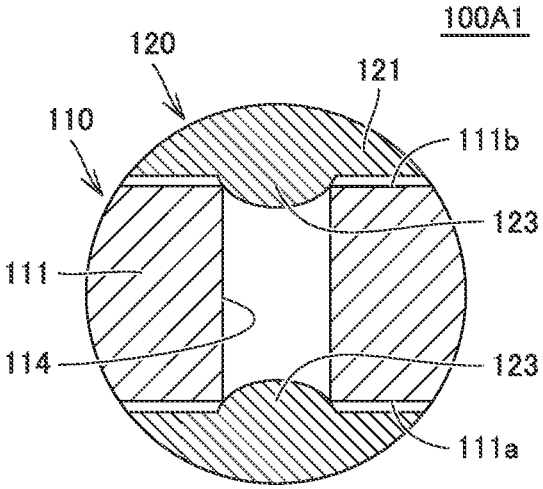
FIGS. 13A to 13F each are a schematic cross-sectional view for illustrating an assembly structure of plate-shaped parts in a last according to a corresponding one of first to sixth modifications.

As shown in FIG. 13A, in the last 100A1 according to the first modification, the amount of protrusion of each of the pair of engaging portions 123 is smaller than that of the last 100A according to the first embodiment. Also in such a configuration, the same effect as that described in the first embodiment is achieved, and further, the assembly operation can be performed with smaller force, with the result that the workability is improved.

Figure 13D:
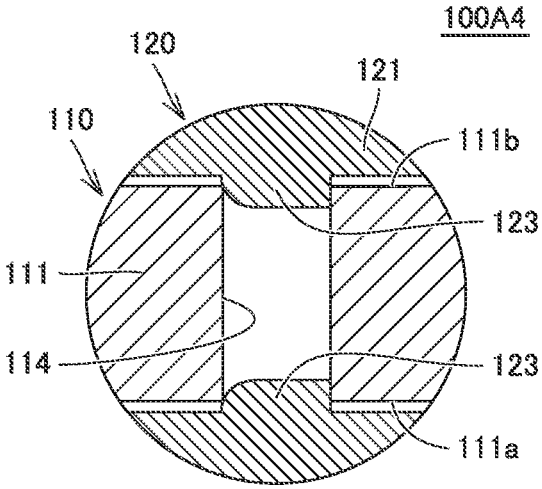
Figure 13B:
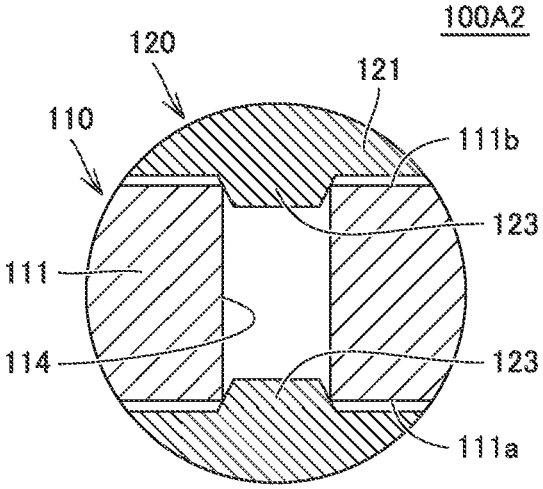

As shown in FIG. 13B, in the last 100A2 according to the second modification, the pair of engaging portions 123 each are formed to have a trapezoidal cross-sectional shape. Also in such a configuration, the same effect as that described in the first embodiment is achieved. Further, when the amount of protrusion of each of the pair of engaging portions 123 is relatively small, the assembly operation can be performed with smaller force, with the result that the workability is improved.

Figure 13E:
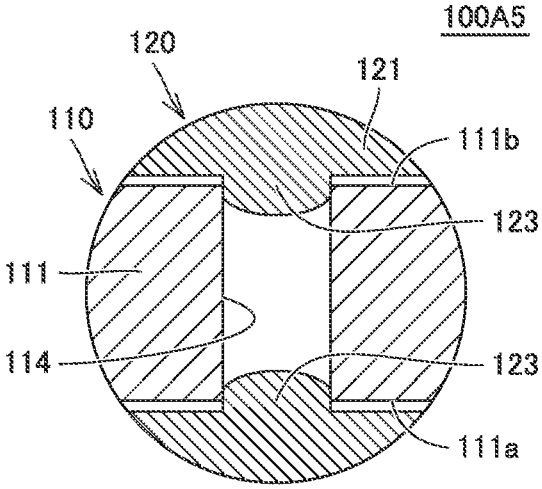
Figure 13C:
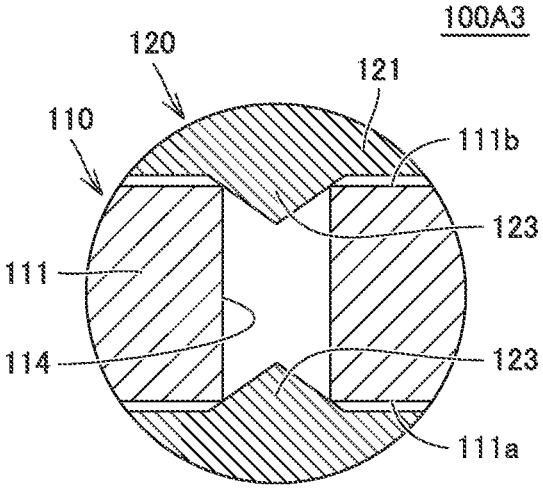

As shown in FIG. 13C, in the last 100A3 according to the third modification, the pair of engaging portions 123 each are formed to have a triangular cross-sectional shape. Also in such a configuration, the same effect as that described in the first embodiment is achieved. Further, when the amount of protrusion of each of the pair of engaging portions 123 is relatively small, the assembly operation can be performed with smaller force, with the result that the workability is improved.

As shown in FIG. 13D, in the last 100A4 according to the fourth modification, the pair of engaging portions 123 each are formed to have a substantially rectangular cross-sectional shape in which some of the corners are rounded. Also in such a configuration, the same effect as that described in the first embodiment is achieved. Further, when the amount of protrusion of each of the pair of engaging portions 123 is relatively small, the assembly operation can be performed with smaller force, with the result that the workability is improved. In addition, after assembly, the pair of engaging portions 123 and the to-be-engaged portion 114 are more firmly engaged at each non-rounded corner, which can result in what is called a fixedly fitted state in which the pair of engaging portions 123 are not easily disengaged toward the non-rounded corner.

As shown in FIG. 13E, in the last 100A5 according to the fifth modification, the pair of engaging portions 123 each are formed to have a substantially rectangular cross-sectional shape having a bulged end. Also in such a configuration, the same effect as that described in the first embodiment is achieved. Further, when the amount of protrusion of each of the pair of engaging portions 123 is relatively small, the assembly operation can be performed with smaller force, with the result that the workability is improved.

Figure 13F:
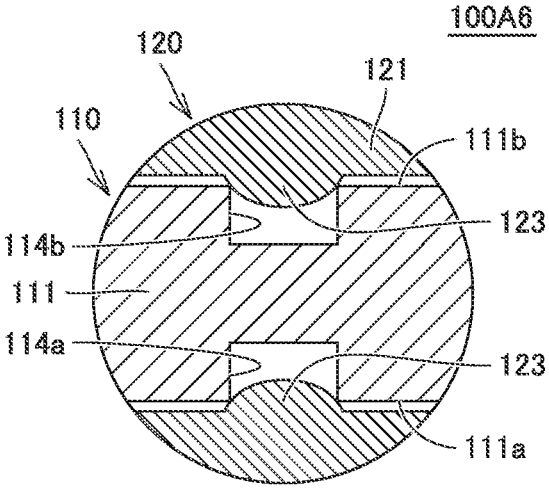

As shown in FIG. 13F, in the last 100A6 according to the sixth modification, similarly to the last 100A1 according to the first modification, the amount of protrusion of each of the pair of engaging portions 123 is smaller than that in the last 100A according to the first embodiment. Further, in place of the to-be-engaged portion 114 having a through hole shape (see FIG. 13A), a pair of to-be-engaged portions 114*a* and 114*b* each having a recessed shape are provided, so that one of the pair of engaging portions 123 is engaged with the to-be-engaged portion 114*a* having a recessed shape and provided in the main surface 111*a* while the other of the pair of engaging portions 123 is engaged with the to-be-engaged portion 114*b* having a recessed shape and provided in the main surface 111*b*. Also in such a configuration, the same effect as that described in the first embodiment is achieved, and further, the assembly operation can be performed with smaller force, with the result that the workability is improved.

In this way, the pair of engaging portions 113 and the to-be-engaged portion 114 provided in the first part 110 and the pair of engaging portions 123 and the to-be-engaged portion 124 provided in the second part 120 can be variously changed in shape.

Seventh Modification

Figure 14:
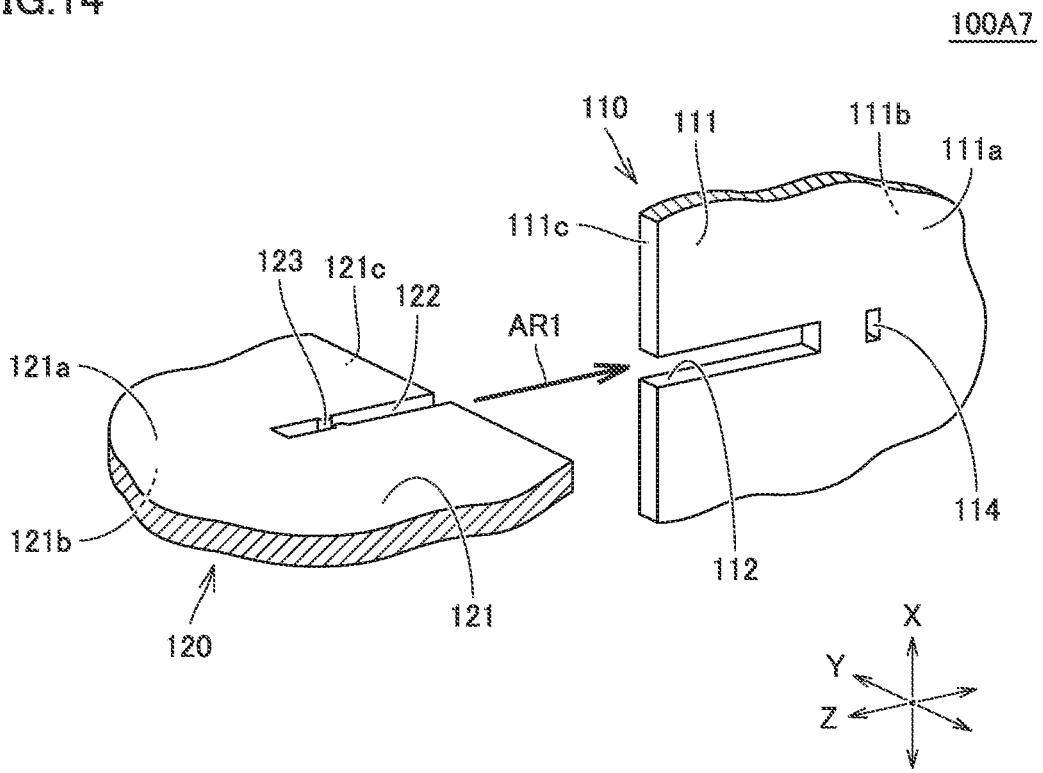
FIG. 14 is a partially cutaway perspective view for illustrating an assembly structure of plate-shaped parts in a last according to a seventh modification.

FIG. 14 is a partially cutaway perspective view for illustrating an assembly structure of plate-shaped parts in a last according to the seventh modification. Referring to FIG. 14, a last 100A7 according to the seventh modification based on the above-described first embodiment will be hereinafter described.

As shown in FIG. 14, the last 100A7 according to the seventh modification is different from the last 100A according to the above-described embodiment only in that the first part 110 is not provided with the pair of engaging portions 113 (see FIG. 11 and the like), and the second part 120 is not provided with the to-be-engaged portion 124 (see FIG. 11 and the like).

In such a configuration, the first plate-shaped portion 111 is fitted into the slit 122, so that the first part 110 and the second part 120 are fixed in the Y-axis direction shown in the figure. Further, the second plate-shaped portion 121 is fitted into the slit 112, so that the first part 110 and the second part 120 are fixed in the X-axis direction shown in the figure. Thus, the to-be-engaged portion 114 is engaged by the engaging portion 123, so that the first part 110 and the second part 120 are fixed in the X-axis direction and the Z-axis direction shown in the figure.

Therefore, also in such a configuration, the same effect as that described in the first embodiment is achieved.

Eighth Modification

Figure 15:
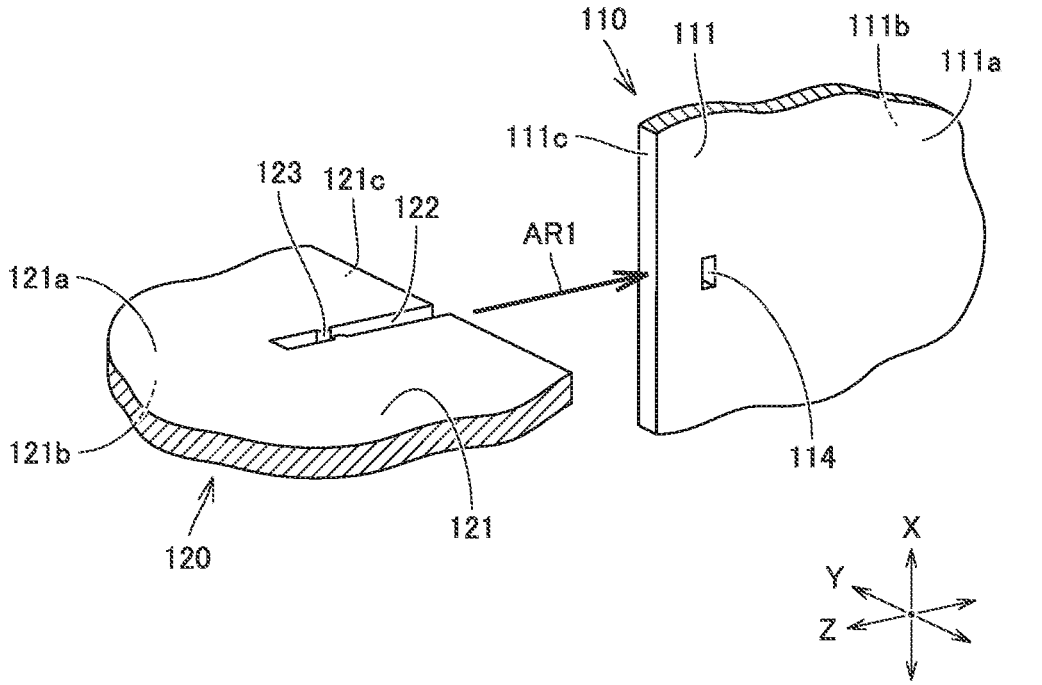
FIG. 15 is a partially cutaway perspective view for illustrating an assembly structure of plate-shaped parts in a last according to an eighth modification.

FIG. 15 is a partially cutaway perspective view for illustrating an assembly structure of plate-shaped parts in a last according to the eighth modification.

Referring to FIG. 15, a last 100A8 according to the eighth modification based on the above-described first embodiment will be hereinafter described.

As shown in FIG. 15, the last 100A8 according to the eighth modification is different from the last 100A7 according to the above-described seventh modification only in that the first part 110 is not provided with the slit 112 (see FIG. 14).

In such a configuration, the first plate-shaped portion 111 is fitted into the slit 122, so that the first part 110 and the second part 120 are fixed in the Y-axis direction shown in the figure. Also, the to-be-engaged portion 114 is engaged by the engaging portion 123, so that the first part 110 and the second part 120 are fixed in the X-axis direction and the Z-axis direction shown in the figure.

Therefore, also in such a configuration, the same effect as that described in the seventh modification is achieved.

Ninth Modification

Figure 16:
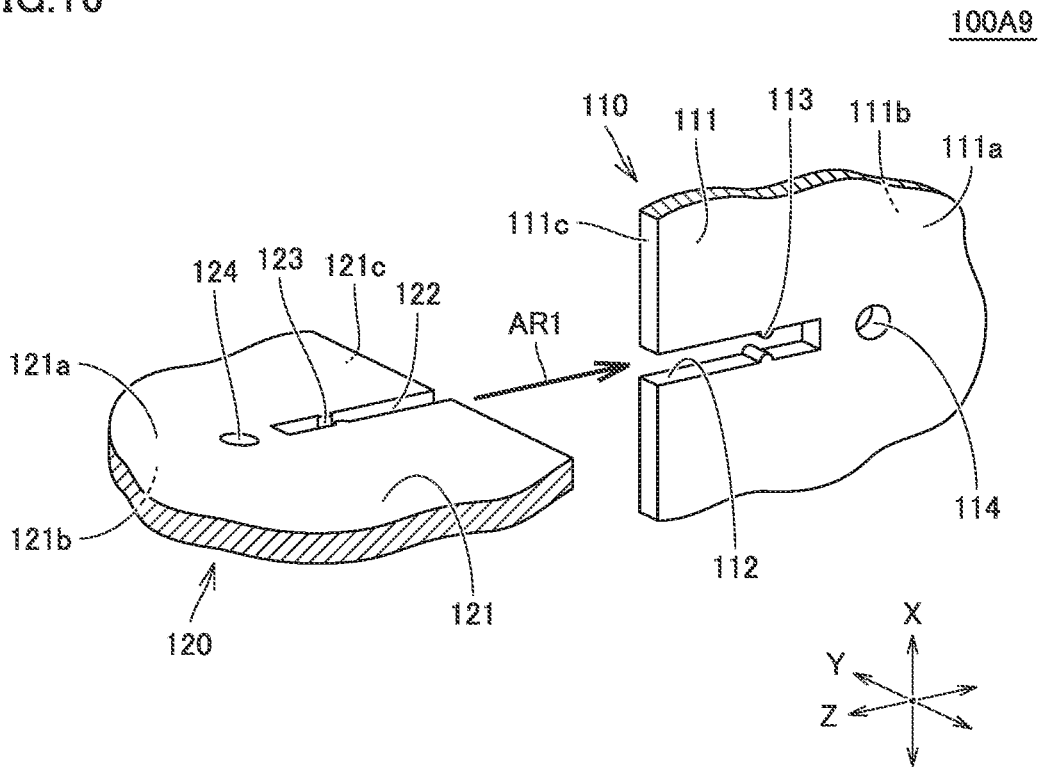
FIG. 16 is a partially cutaway perspective view for illustrating an assembly structure of plate-shaped parts in a last according to a ninth modification.

FIG. 16 is a partially cutaway perspective view for illustrating an assembly structure of plate-shaped parts in a last according to the ninth modification. Referring to FIG. 16, a last 100A9 according to the ninth modification based on the above-described first embodiment will be hereinafter described.

As shown in FIG. 16, in the last 100A9 according to the ninth modification, the to-be-engaged portion 114 having a through hole shape and provided in the first part 110 and the to-be-engaged portion 124 having a through hole shape and provided in the second part 120 are circular in a plan view. The to-be-engaged portions 114 and 124 that are circular in a plan view are sized to be fitted into and engaged by the engaging portions 123 and 113, respectively.

Also in such a configuration, the same effect as that described in the first embodiment is achieved.

Tenth Modification

Figure 17:
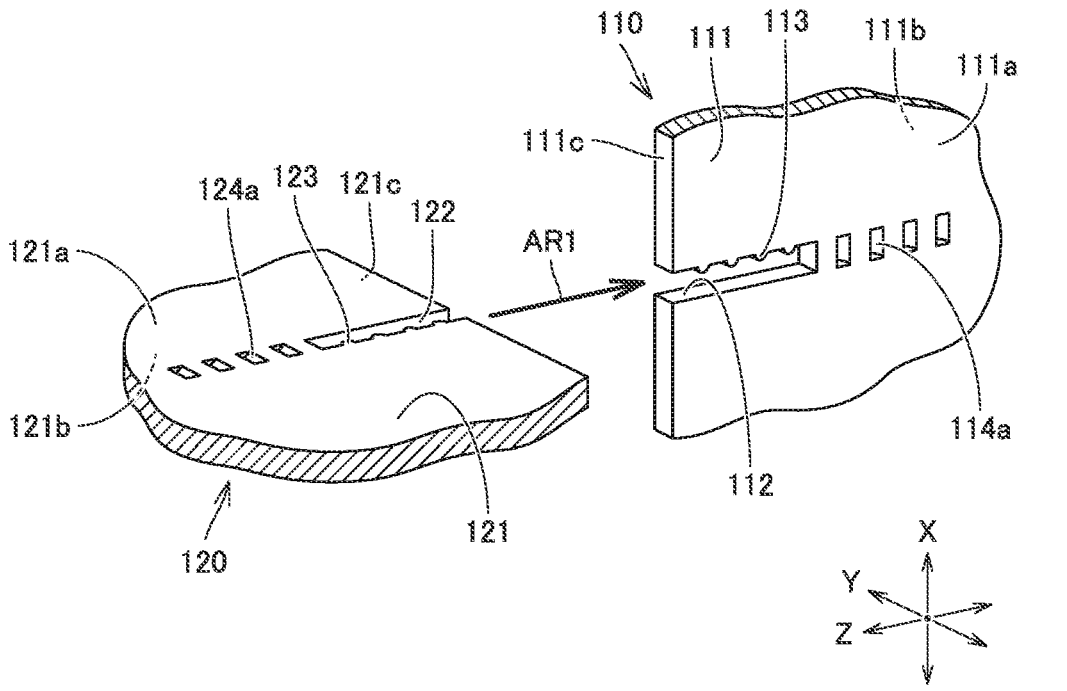
FIG. 17 is a partially cutaway perspective view for illustrating an assembly structure of plate-shaped parts in a last according to a tenth modification.

FIG. 17 is a partially cutaway perspective view for illustrating an assembly structure of plate-shaped parts in a last according to the tenth modification. Referring to FIG. 17, a last 100A10 according to the tenth modification based on the above-described first embodiment will be hereinafter described.

As shown in FIG. 17, the last 100A10 according to the tenth modification is different from the last 100A according to the first embodiment in the configurations of: the engaging portion 113 and the to-be-engaged portion 114*a* (the to-be-engaged portion 114 in the first embodiment) provided in the first part 110; and the engaging portion 123 and the to-be-engaged portion 124*a* (the to-be-engaged portion 124 in the first embodiment) provided in the second part 120.

Specifically, a plurality of the engaging portions 123 provided in the second part 120 are provided on only one of the pair of inner side surfaces of the second plate-shaped portion 121 in a portion defining the slit 122. The plurality of engaging portions 123 are arranged side by side in the extending direction of the slit 122. Further, in the first part 110, in place of the to-be-engaged portion 114 having a through hole shape (see FIG. 11 and the like), a plurality of the to-be-engaged portions 114*a* each having a recessed shape are provided in the main surface 111*a* of the first plate-shaped portion 111. The plurality of to-be-engaged portions 114*a* are arranged side by side in the direction in which the first plate-shaped portion 111 is inserted into the slit 122 provided in the second part 120.

On the other hand, a plurality of the engaging portions 113 provided in the first part 110 are provided on only one of the pair of inner side surfaces of the first plate-shaped portion 111 in a portion defining the slit 112. The plurality of engaging portions 113 are arranged side by side in the extending direction of the slit 112. Further, in the second part 120, in place of the to-be-engaged portion 124 having a through hole shape (see FIG. 11 and the like), a plurality of the to-be-engaged portions 124*a* each having a recessed shape are provided in the main surface 121*a* of the second plate-shaped portion 121. The plurality of to-be-engaged portions 124*a* are arranged side by side in the direction in which the second plate-shaped portion 121 is inserted into the slit 112 provided in the first part 110.

In such a configuration, the first plate-shaped portion 111 is fitted into the slit 122, so that the first part 110 and the second part 120 are fixed in the Y-axis direction shown in the figure. Also, the second plate-shaped portion 121 is fitted into the slit 112, so that the first part 110 and the second part 120 are fixed in the X-axis direction shown in the figure. Further, the plurality of to-be-engaged portions 114*a* are engaged by the plurality of engaging portions 123, so that the first part 110 and the second part 120 are fixed in the X-axis direction and the Z-axis direction shown in the figure. Also, the plurality of to-be-engaged portions 124*a* are engaged by the plurality of engaging portions 113, so that the first part 110 and the second part 120 are fixed in the Y-axis direction and the Z-axis direction shown in the figure.

Therefore, also in such a configuration, not only the same effect as that described in the first embodiment can be achieved, but also the portion at which the first part 110 and the second part 120 are engaged is increased in number as the engaging portions 113 and 123 and the to-be-engaged portions 114*a* and 124*a* are increased in number, and accordingly, the first part 110 and the second part 120 can be more firmly fixed to each other.

Eleventh Modification

Figure 18:
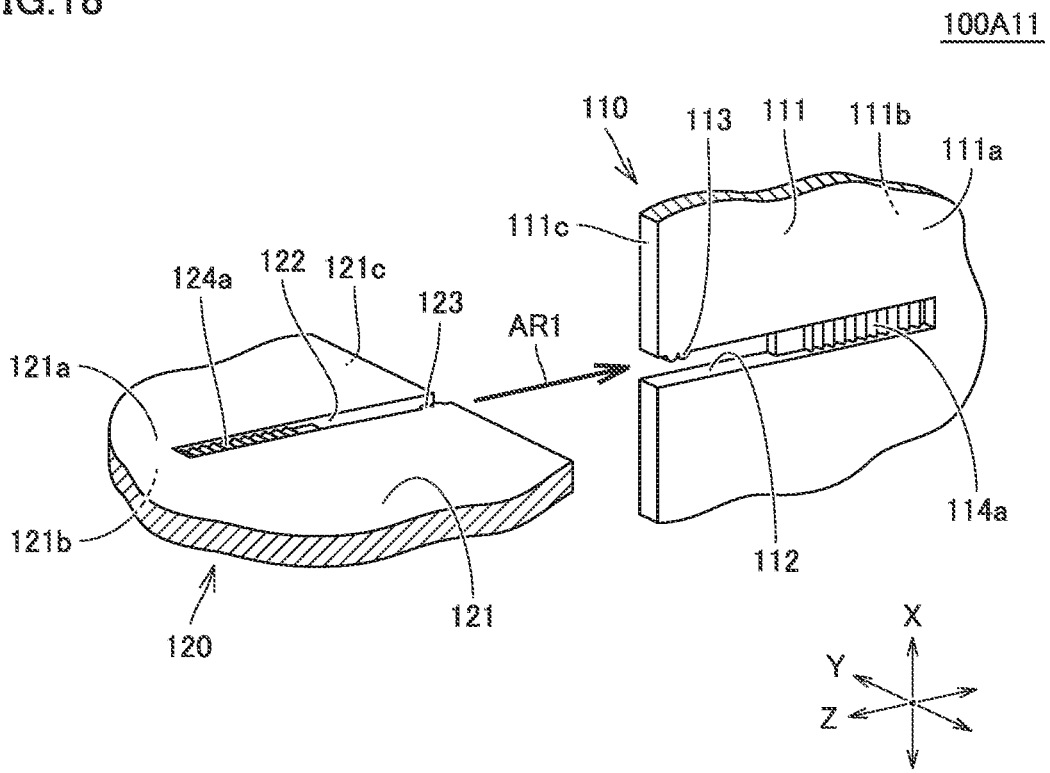
FIG. 18 is a partially cutaway perspective view for illustrating an assembly structure of plate-shaped parts in a last according to an eleventh modification.

FIG. 18 is a partially cutaway perspective view for illustrating an assembly structure of plate-shaped parts in a last according to the eleventh modification. Referring to FIG. 18, a last 100A11 according to the eleventh modification based on the above-described first embodiment will be hereinafter described.

As shown in FIG. 18, the last 100A11 according to the eleventh modification is different from the last 100A10 according to the tenth modification only in the configuration of the plurality of engaging portions 113 and the plurality of to-be-engaged portions 114*a* provided in the first part 110 and the configuration of the plurality of engaging portions 123 and the plurality of to-be-engaged portions 124*a* provided in the second part 120.

Specifically, as compared with the last 100A10 according to the tenth modification, in the last 100A11 according to the eleventh modification, the plurality of engaging portions 123 provided in the second part 120 are smaller in number and disposed in the slit 122 collectively at positions relatively close to the end surface 121*c*, and the plurality of to-be-engaged portions 114*a* each having a recessed shape and provided in the first part 110 are larger in number and disposed adjacent to each other.

Further, the plurality of engaging portions 113 provided in the first part 110 are also smaller in number and disposed in the slit 112 collectively at positions relatively close to the end surface 111*c*, and the plurality of to-be-engaged portions 124*a* each having a recessed shape and provided in the second part 120 are also larger in number and disposed adjacent to each other.

Also in such a configuration, the same effect as that described in the tenth modification is achieved.

Second Embodiment

Figure 19:
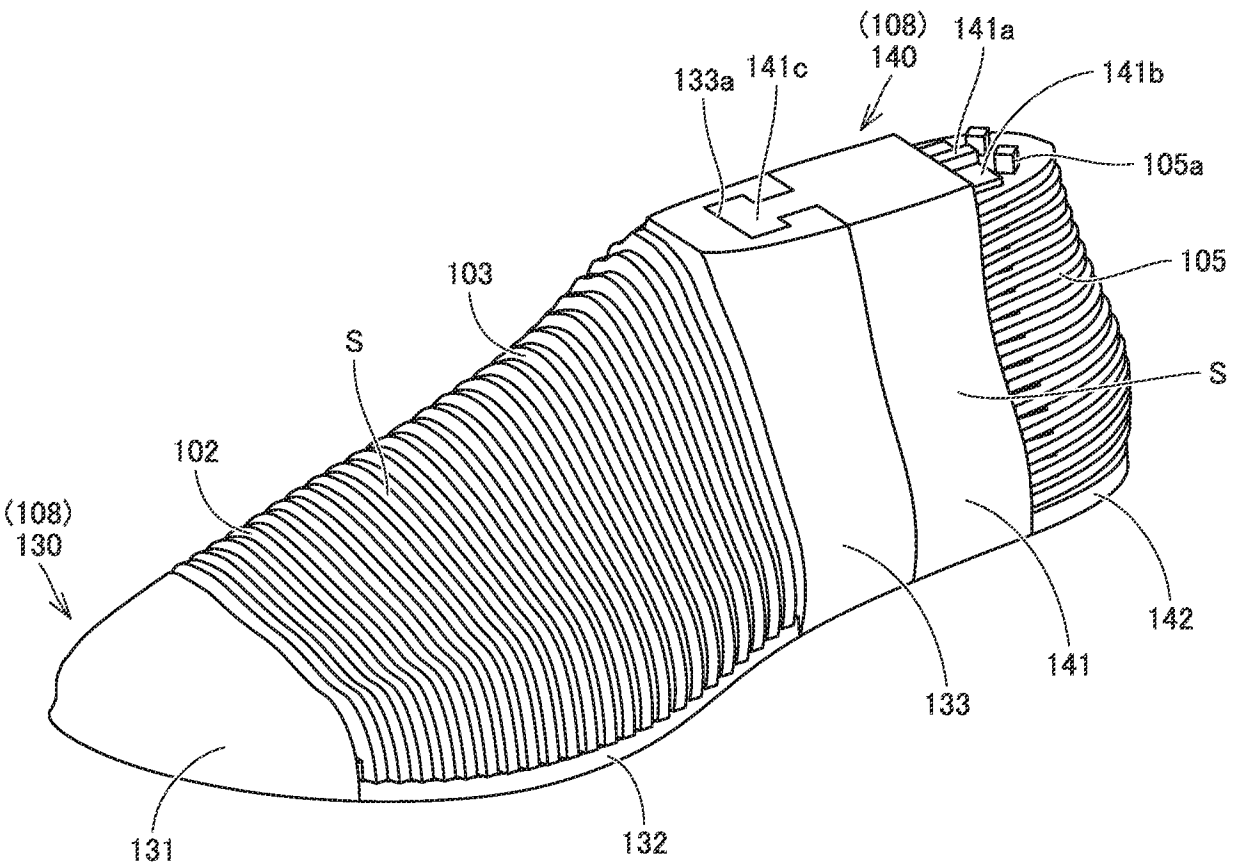
FIG. 19 is a perspective view of a last according to a second embodiment.
Figure 20:
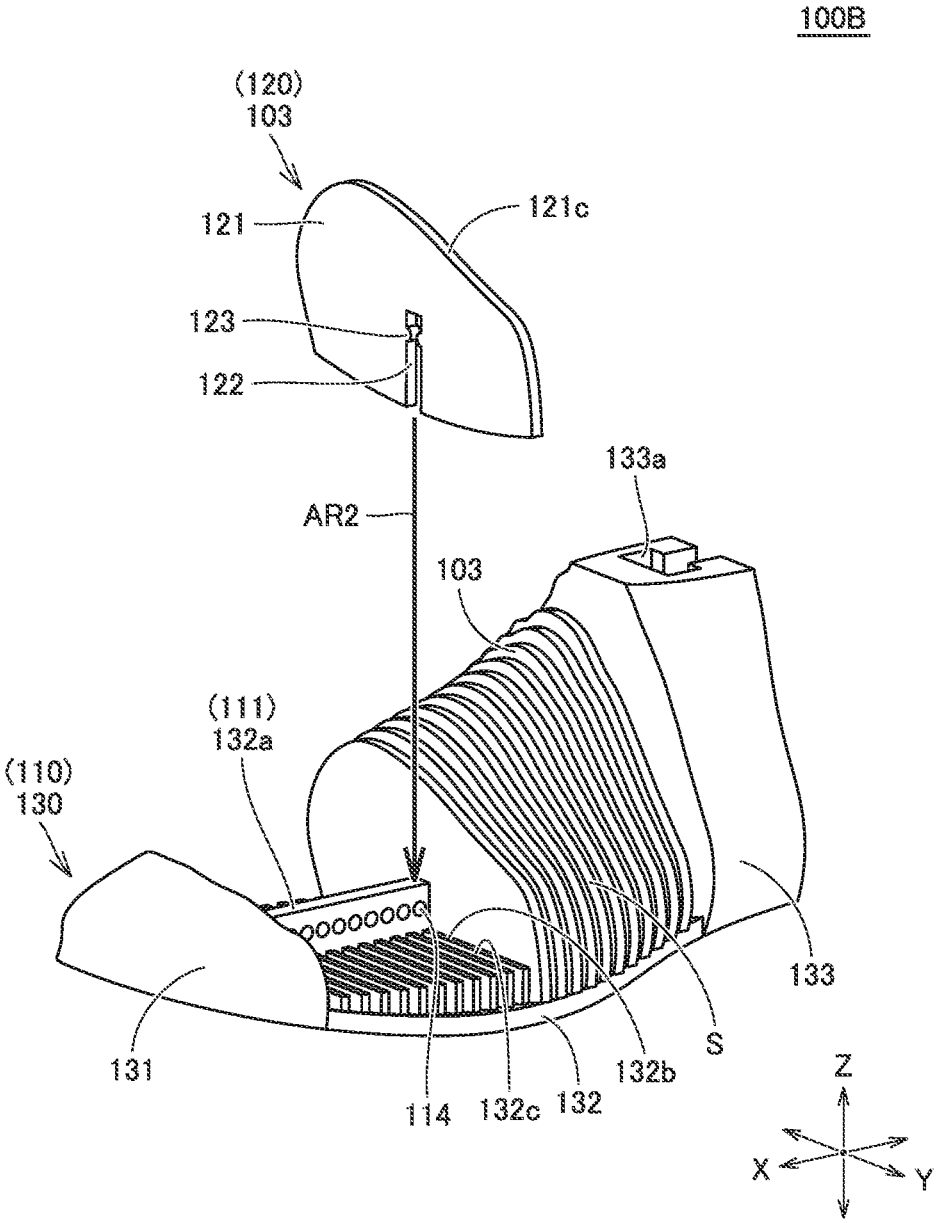
FIG. 20 is a perspective view showing an assembly method for the last shown in FIG. 19.
Figure 21:
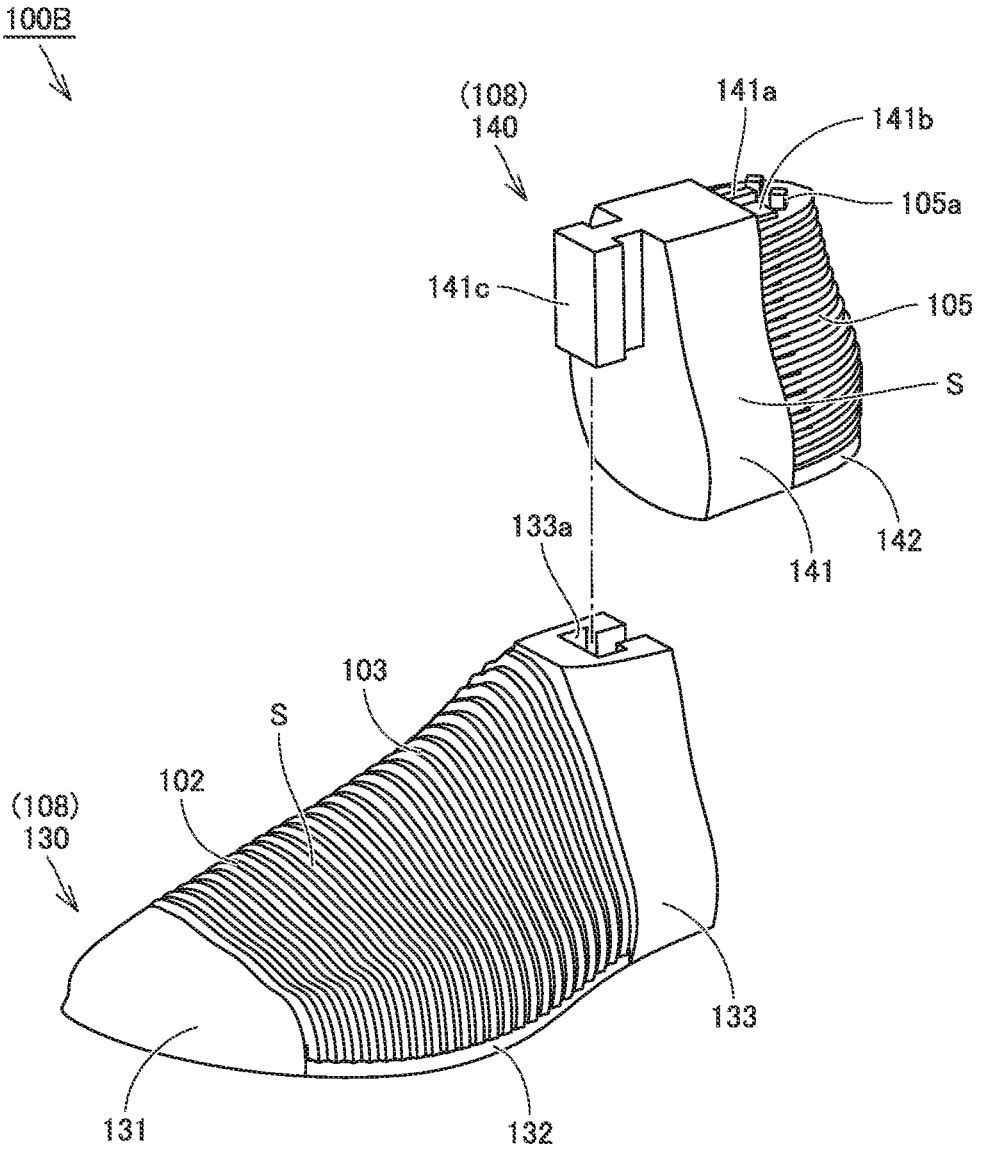
FIG. 21 is an exploded perspective view of a base part of the last shown in FIG. 19.

FIG. 19 is a perspective view of a last according to the second embodiment. FIG. 20 is a perspective view showing an assembly method for the last shown in FIG. 19. FIG. 21 is an exploded perspective view of a base part of the last shown in FIG. 19. Referring to FIGS. 19 to 21, a last 100B according to the present embodiment will be hereinafter described. Note that the last 100B according to the present embodiment is fabricated according to the above-described method of producing a last model and basically conforms to the shape of a wearer's foot.

As shown in FIG. 19, the last 100B is formed by combining a plurality of last forming parts that are detachable. The plurality of last forming parts include a base part 108 as a block-shaped part, and a plurality of toe parts 102, a plurality of instep parts 103, and a plurality of circumferential heel parts 105 as plate-shaped parts. The base part 108 is divided into two parts of a front-side base part 130 and a rear-side base part 140.

The front-side base part 130 includes: a front end-side toe portion 131 corresponding to the front end of the wearer's toe; a front-side foot sole portion 132 corresponding to the foot sole located at positions corresponding to the rear end of the wearer's toe and the wearer's instep; and a front-side ankle portion 133 corresponding to the front end of the wearer's ankle. Further, the rear-side base part 140 includes: a rear-side ankle portion 141 corresponding to the rear end of the wearer's ankle; and a rear-side foot sole portion 142 corresponding to the foot sole located at a position corresponding to the wearer's heel.

The base part 108 formed of the front-side base part 130 and the rear-side base part 140 serves as a base frame to which the above-described plurality of plate-shaped parts are assembled, and defines the bottom surface of the last 100B. The front-side base part 130 and the rear-side base part 140 each may be made, for example, of resin, metal, wood, or the like, and are preferably made of hard resin.

On the other hand, the plurality of toe parts 102, the plurality of instep parts 103, and the plurality of circumferential heel parts 105 have basically the same configurations as those in the last 100A according to the above-described first embodiment, and each are formed of a wooden board. In this case, the plurality of toe parts 102 and the plurality of instep parts 103 are arranged in a multilayered manner in the front-rear direction (i.e., in the foot length direction), and the plurality of circumferential heel parts 105 are arranged in a multilayered manner in the up-down direction (i.e., in the direction orthogonal to both the foot length direction and the foot width direction).

The base part 108, the plurality of toe parts 102, the plurality of instep parts 103, and the plurality of circumferential heel parts 105 are combined to define a forming surface S of the last 100B. More specifically, the outer surface of the base part 108 defines the forming surface S of the last 100B. Also, the end surfaces of the plurality of toe parts 102, the plurality of instep parts 103, and the plurality of circumferential heel parts 105 (i.e., the surfaces extending in the thickness direction of the plate-shaped parts) define the forming surface S of the last 100B.

In this case, the portion of the forming surface S that is defined by the base part 108 corresponds to a portion of the entire outer surface of the foot that is less likely to be different in shape for each wearer. On the other hand, the portion of the forming surface S that is defined by each of the plurality of toe parts 102, the plurality of instep parts 103, and the plurality of circumferential heel parts 105 corresponds to a portion of the entire outer surface of the foot that is more likely to be different in shape for each wearer.

Thus, in the case where the last 100B is configured by combining the base part 108 as a block-shaped part with the plurality of toe parts 102, the plurality of instep parts 103, and the plurality of circumferential heel parts 105 as a plurality of plate-shaped parts in this way, the last can be more efficiently fabricated by preparing the base part 108 in advance for each size of the shoe to be manufactured.

In this case, as shown in FIG. 20, a slit having a cutout shape and an engaging portion having a protruding shape are provided at prescribed positions in the plurality of plate-shaped parts while a plate-shaped portion and a to-be-engaged portions having a through hole shape are provided in the block-shaped part. The slit, the engaging portion, the plate-shaped portion, and the to-be-engaged portion each serve as an assembly section at which the plurality of plate-shaped parts and the block-shaped part are assembled together.

Note that FIG. 20 exemplarily illustrates the state in the middle of assembly of the last 100B, and shows a step of assembling one of the plurality of instep parts 103 into the front-side base part 130. Referring to FIG. 20, the following description is given while focusing on an assembly section of the front-side base part 130 and one instep part 103 of the plurality of instep parts 103. In this description, the front-side base part 130 is defined as the first part 110, and the one instep part 103 is defined as the second part 120.

As shown in FIG. 20, the first part 110 includes: a front-side guide portion 132*a* extending in the front-rear direction (i.e., in the foot length direction); and a plurality of front-side partition portions 132*b* extending in the direction intersecting with the extending direction of the front-side guide portion 132*a*. The front-side guide portion 132*a* and the front-side partition portions 132*b* each are provided on the upper surface of the front-side foot sole portion 132. Among them, the front-side guide portion 132*a* corresponds to the first plate-shaped portion 111 provided in the first part 110, and thus, will be referred to as the first plate-shaped portion 111 in the following description.

On the main surface of the first plate-shaped portion 111, a to-be-engaged portion 114 serving as the first part-side to-be-engaged portion is provided. The to-be-engaged portion 114 has a through hole shape, and is provided in the first plate-shaped portion 111 so as to reach a pair of main surfaces of the first plate-shaped portion 111 (i.e., to extend in the foot width direction). The to-be-engaged portion 114 is circular in a plan view.

Further, the second part 120 includes a second plate-shaped portion 121. The second plate-shaped portion 121 is provided with a slit 122 that is the second part-side slit serving as the second part-side receiving portion, and a pair of engaging portions 123 each serving as the second part-side engaging portion.

The slit 122 is formed in a cutout shape linearly extending so as to reach the end surface 121*c* of the second plate-shaped portion 121. A pair of engaging portions 123 are provided on the inner side surfaces of the second plate-shaped portion 121 in a portion defining the slit 122. Each of the pair of engaging portions 123 has a protruding shape. One and the other of the pair of engaging portions 123 are provided on one and the other of the pair of inner side surfaces such that the pair of engaging portions 123 face each other in the direction intersecting with the extending direction of the slit 122. The pair of engaging portions 123 each have a semi-cylindrical shape.

When the first part 110 and the second part 120 are assembled together, the first plate-shaped portion 111 of the first part 110 and the second plate-shaped portion 121 of the second part 120 are directed so as to intersect with each other, and positioned such that the slit 122 provided in the second part 120 is located at a position corresponding to the to-be-engaged portion 114 provided in the first part 110. Then, in this state, the second part 120 is pushed into the first part 110 in the direction indicated by an arrow AR2 shown in the figure.

Thereby, the first plate-shaped portion 111 of the first part 110 is received in the slit 122 provided in the second part 120, and the second plate-shaped portion 121 of the second part 120 is received in a gap portion 132*c* located between the pair of adjoining front-side partition portions 132*b* provided in the first part 110, with the result that the first plate-shaped portion 111 and the second plate-shaped portion 121 are engaged with each other.

In this case, the first plate-shaped portion 111 is inserted into the slit 122, and thereby, not only the first plate-shaped portion 111 is fitted into the slit 122, but also the pair of engaging portions 123 each having a protruding shape and provided in the second part 120 are fitted into the to-be-engaged portion 114 having a through hole shape and provided in the first part 110. As a result, the to-be-engaged portion 114 is engaged by the pair of engaging portions 123.

At this time, a portion of the to-be-engaged portion 114 that is exposed in one of the pair of main surfaces of the first plate-shaped portion 111 is engaged by one of the pair of engaging portions 123, and a portion of the to-be-engaged portion 114 that is exposed in the other of the pair of main surfaces of the first plate-shaped portion 111 is engaged by the other of the pair of engaging portions 123.

By the configuration as described above, the first plate-shaped portion 111 is fitted into the slit 122, so that the first part 110 and the second part 120 are fixed in the Y-axis direction shown in the figure, and the second plate-shaped portion 121 is fitted into the above-mentioned gap portion 132*c*, so that the first part 110 and the second part 120 are fixed in the X-axis direction shown in the figure. Also, the to-be-engaged portion 114 is engaged by the engaging portion 123, so that the first part 110 and the second part 120 are fixed in the X-axis direction and the Z-axis direction shown in the figure.

Thus, by employing the above-described configuration, the first part 110 and the second part 120 can be firmly fixed to each other in a simple operation of positioning the first part 110 and the second part 120 and then pushing the second part 120 into the first part 110. In the last 100B according to the present embodiment, the above-described assembly structure or an assembly structure similar thereto is applied to each of the assembly sections for all the plate-shaped parts and the block-shaped part included in the last 100B.

Figure 22:
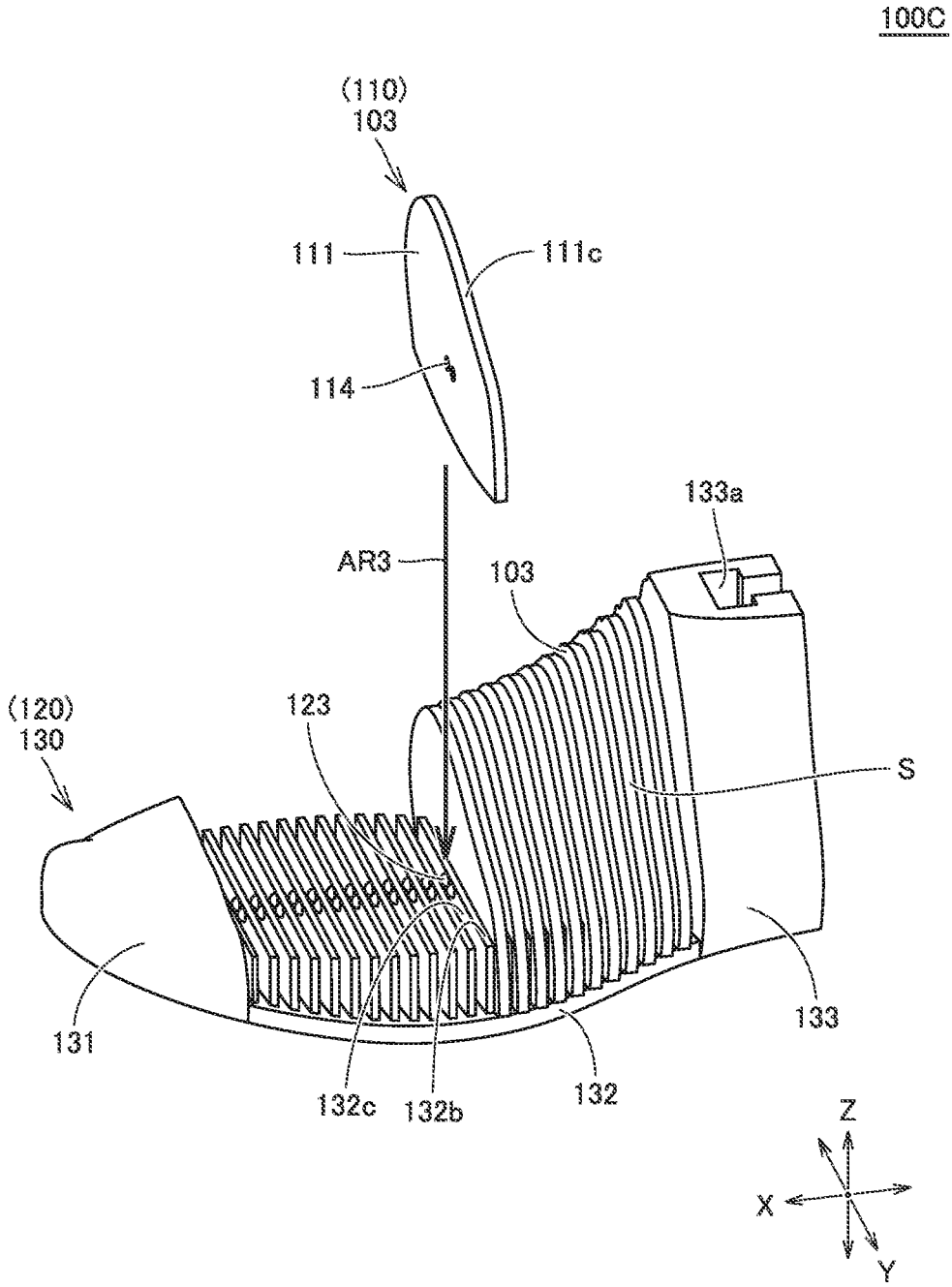
FIG. 22 is a perspective view showing an assembly method for a last according to a third embodiment.

In particular, as shown in FIGS. 20 and 22, similarly to the above-described front-side base part 130, the rear-side base part 140 as the first part has a rear end surface provided with a rear-side guide portion 141*a* as the first plate-shaped portion and a plurality of rear-side partition portions 141*b*. Also, similarly to one of the above-described plurality of instep parts 103, each of the plurality of circumferential heel parts 105 as the second parts includes a second plate-shaped portion and, though not shown in the figures, a second part-side slit as the second part-side receiving portion, and a second part-side engaging portion. These portions allow firm assembly of the rear-side base part 140 and the plurality of circumferential heel parts 105.

A fixing bar 105*a* shown in the figure is inserted into a through hole provided in each of the plurality of circumferential heel parts 105 to thereby fix the plurality of circumferential heel parts 105 to each other in an auxiliary manner.

Therefore, according to the last 100B in the present embodiment, the plurality of plate-shaped parts included in the last 100B can be easily and reliably fixed to the block-shaped part, and the last having such mechanical strength as preventing easy disengagement of these plate-shaped parts can be speedily and simply fabricated.

In this case, in the last 100B according to the present embodiment, as shown in FIG. 20, a plurality of the to-be-engaged portions 114 mentioned above are arranged in line in the front-side guide portion 132*a* as the first plate-shaped portion 111 provided in the front-side base part 130 as the first part 110. More specifically, the plurality of to-be-engaged portions 114 are provided to extend in the direction intersecting with the direction in which the front-side guide portion 132*a* is inserted into the slit 122 provided in the second part 120 and in the direction intersecting with the main surface of the second plate-shaped portion 121 of the second part 120.

By the configuration as described above, the plurality of plate-shaped parts arranged in line can be assembled into the block-shaped part, with the result that the plurality of plate-shaped parts can be arranged in a multilayered manner as described above.

Further, in the last 100B according to the present embodiment, as shown in FIGS. 19 and 21, the front-side ankle portion 133 of the front-side base part 130 is provided with a recessed engagement portion 133*a* so as to reach the upper surface and the rear end surface of the front-side ankle portion 133, and the front end surface of the rear-side ankle portion 141 of the rear-side base part 140 is provided with a protruding engagement portion 141*c*. The recessed engagement portion 133*a* and the protruding engagement portion 141*c* are configured to fit each other in the up-down direction (i.e., in the direction orthogonal to both the foot length direction and the foot width direction).

Thereby, as shown in FIG. 21, the rear-side base part 140 can be insertable into and removable from the front-side base part 130 in the up-down direction. Thus, after the upper 30 is formed, at this portion, the rear-side base part 140 is disengaged from the front-side base part 130, and thereby, the rear-side base part 140 and the front-side base part 130 can be easily taken out in this order from the topline 31 of the upper 30.

Third Embodiment

FIG. 22 is a perspective view showing an assembly method for a last according to the third embodiment. Referring to FIG. 22, a last 100C according to the present embodiment will be hereinafter described. Note that the last 100C according to the present embodiment is fabricated according to the above-described method of producing a last model and basically conforms to the shape of a wearer's foot.

As shown in FIG. 22, the last 100C according to the present embodiment is different from the last 100B according to the above-described second embodiment only in the configuration of a portion serving as an assembly section at which a plurality of plate-shaped parts and a block-shaped part are assembled together.

Specifically, a receiving portion having a slit shape and an engaging portion having a protruding shape are provided in the block-shaped part, and a to-be-engaged portion having a through hole shape is provided at a prescribed position in each of the plurality of plate-shaped parts. The receiving portion, the engaging portion, and the to-be-engaged portion each serve as an assembly section at which the plurality of plate-shaped parts and the block-shaped part are assembled together.

Note that FIG. 22 exemplarily illustrates the state in the middle of assembly of the last 100C, and shows a step of assembling one of the plurality of instep parts 103 into the front-side base part 130. Referring to FIG. 22, the following description is given while focusing on an assembly section of the front-side base part 130 and one of the plurality of instep parts 103. In the following description, one instep part 103 is defined as the first part 110, and the front-side base part 130 is defined as the second part 120.

As shown in FIG. 22, the first part 110 includes a first plate-shaped portion 111. On the main surface of the first plate-shaped portion 111, a to-be-engaged portion 114 serving as a first part-side to-be-engaged portion is provided. The to-be-engaged portion 114 is formed in a through hole shape, and provided in the first plate-shaped portion 111 so as to reach a pair of main surfaces of the first plate-shaped portion 111. The to-be-engaged portion 114 is circular in a plan view.

On the other hand, the second part 120 is provided with: a plurality of front-side partition portions 132*b* extending in the right-left direction (that is, in the foot width direction); and a gap portion 132*c* located between a pair of adjoining front-side partition portions 132*b* among the plurality of front-side partition portions 132*b*. The gap portion 132*c* corresponds to a second part-side receiving portion provided in the second part 120.

A pair of engaging portions 123 are provided on the main surface of the front-side partition portion 132*b* in a portion defining the gap portion 132*c*, and the pair of engaging portions 123 each have a protruding shape. One and the other of the pair of engaging portions 123 are provided on a main surface of one front-side partition portion 132*b* and a main surface of the other front-side partition portion 132*b*, respectively, of the pair of adjoining and facing front-side partition portions 132*b* such that the pair of engaging portions 123 face each other in the direction intersecting with the extending direction of the gap portion 132*c*. The pair of engaging portions 123 each have a semicircular shape.

When the first part 110 and the second part 120 are assembled together, the first part 110 and the second part 120 are directed such that the gap portion 132*c* serving as the second part-side receiving portion of the second part 120 and the first plate-shaped portion 111 of the first part 110 extend in parallel with each other, and are positioned such that the to-be-engaged portion 114 provided in the first part 110 is located at a position corresponding to the pair of engaging portions 123 provided in the second part 120. Then, in this state, first part 110 is pushed into the second part 120 in the direction indicated by an arrow AR3 shown in the figure.

Thereby, the first plate-shaped portion 111 of the first part 110 is received in the gap portion 132*c* provided in the second part 120, with the result that the first plate-shaped portion 111 and the front-side partition portion 132*b* are engaged with each other.

In this case, the first plate-shaped portion 111 is inserted into the gap portion 132*c*, and thereby, not only the first plate-shaped portion 111 is fitted into the gap portion 132*c*, but also the pair of engaging portions 123 each having a protruding shape and provided in the second part 120 are fitted into the to-be-engaged portion 114 having a through hole shape and provided in the first part 110. As a result, the to-be-engaged portion 114 is engaged by the pair of engaging portions 123.

At this time, a portion of the to-be-engaged portion 114 that is exposed in one of the pair of main surfaces of the first plate-shaped portion 111 is engaged by one of the pair of engaging portions 123, and a portion of the to-be-engaged portion 114 that is exposed in the other of the pair of main surfaces of the first plate-shaped portion 111 is engaged by the other of the pair of engaging portions 123.

By the configuration as described above, the first plate-shaped portion 111 is fitted into the gap portion 132*c*, so that the first part 110 and the second part 120 are fixed in the X-axis direction shown in the figure, and the to-be-engaged portion 114 is engaged by the engaging portion 123, so that the first part 110 and the second part 120 are fixed in the Y-axis direction and the Z-axis direction shown in the figure.

Thus, by employing the above-described configuration, the first part 110 and the second part 120 can be firmly fixed to each other in a simple operation of positioning the first part 110 and the second part 120 and then pushing the first part 110 into the second part 120. In the last 100C according to the present embodiment, the above-described assembly structure or an assembly structure similar thereto is applied to each of the assembly sections for all the plate-shaped parts and the block-shaped part included in the last 100C.

Therefore, according to the last 100C in the present embodiment, the plurality of plate-shaped parts included in the last 100C can be easily and reliably fixed to the block-shaped part, and the last having such mechanical strength as preventing easy disengagement of these plate-shaped parts can be speedily and simply fabricated.

In this case, in the last 100C according to the present embodiment, as shown in FIG. 22, a plurality of the front-side partition portions 132*b* provided in the front-side base part 130 as the second part 120 are arranged in line, and thereby, a plurality of the gap portions 132*c* each serving as the second part-side receiving portion defined by the front-side partition portion 132*b* are also arranged in line. More specifically, the plurality of the gap portions 132*c* are provided to extend in the direction intersecting with the direction in which the first plate-shaped portion 111 of the first part 110 is inserted into the gap portion 132*c*, and in the direction intersecting with the main surface of the first plate-shaped portion 111.

By the configuration as described above, the plurality of plate-shaped parts arranged in line can be assembled into the block-shaped part, with the result that the plurality of plate-shaped parts can be arranged in a multilayered manner as described above.

SUMMARY OF THE DISCLOSURE IN EMBODIMENTS

The following summarizes the characteristic configurations disclosed in the above-described embodiments and the modifications thereof.

A last according to an aspect of the present disclosure is for shoe upper forming and is formed by combining a plurality of last forming parts that are detachable, and a shoe upper is overlaid on the last to allow forming of the shoe upper. The last forming parts include a first part and a second part. At least one of the first part and the second part defines a forming surface for forming the shoe upper. The first part includes a first plate-shaped portion, and the second part includes a second part-side receiving portion having a cutout shape. When the first plate-shaped portion is received in the second part-side receiving portion, the first part and the second part are assembled. The second part includes a second part-side engaging portion having a protruding shape on an inner side surface in a portion defining the second part-side receiving portion, and the first plate-shaped portion has a main surface provided with a first part-side to-be-engaged portion having a through hole shape or a recessed shape. In the last according to an aspect of the present disclosure, when the first plate-shaped portion is inserted into the second part-side receiving portion, the first plate-shaped portion is fitted into the second part-side receiving portion, and further, the first part-side to-be-engaged portion is engaged by the second part-side engaging portion.

In the last according to an aspect of the present disclosure, the second part may include a second plate-shaped portion, and the second part-side receiving portion may be formed of a second part-side slit provided in the second plate-shaped portion so as to reach an end surface of the second plate-shaped portion. In this case, it is preferable that the first plate-shaped portion and the second plate-shaped portion are assembled to intersect with each other.

In the last according to an aspect of the present disclosure, a pair of the second part-side engaging portions may be provided so as to face each other in a direction intersecting with an extending direction of the second part-side slit, and the first part-side to-be-engaged portion may have a through hole shape. In this case, it is preferable that a portion of the first part-side to-be-engaged portion that is exposed in one of a pair of main surfaces of the first plate-shaped portion is engaged by one of the pair of the second part-side engaging portions, and a portion of the first part-side to-be-engaged portion that is exposed in the other of the pair of main surfaces of the first plate-shaped portion is engaged by the other of the pair of the second part-side engaging portions.

In the last according to an aspect of the present disclosure, a plurality of the second part-side engaging portions may be provided to extend in an extending direction of the second part-side slit, and a plurality of the first part-side to-be-engaged portions may be provided to extend in a direction in which the first plate-shaped portion is inserted into the second part-side slit. In this case, it is preferable that the plurality of first part-side to-be-engaged portions are engaged by the plurality of second part-side engaging portions.

In the last according to an aspect of the present disclosure, the first part may include a first part-side receiving portion having a cutout shape, the first part-side receiving portion may be formed of a first part-side slit provided in the first plate-shaped portion so as to reach an end surface of the first plate-shaped portion, and further, the first part-side to-be-engaged portion may be provided at a position on a line extending in an extending direction of the first part-side slit. In this case, it is preferable that, when the second plate-shaped portion is inserted into the first part-side slit, the second plate-shaped portion is further fitted into the first part-side slit.

In the last according to an aspect of the present disclosure, the first plate-shaped portion may include a first part-side engaging portion having a protruding shape on an inner side surface in a portion defining the first part-side slit, a second part-side to-be-engaged portion having a through hole shape or a recessed shape may be provided on a main surface of the second plate-shaped portion, and further, the second part-side to-be-engaged portion may be provided at a position on a line extending in an extending direction of the second part-side slit. In this case, it is preferable that the second part-side to-be-engaged portion is engaged by the first part-side engaging portion.

In the last according to an aspect of the present disclosure, a pair of the first part-side engaging portions may be provided so as to face each other in a direction intersecting with the extending direction of the first part-side slit, and the second part-side to-be-engaged portion may have a through hole shape. In this case, it is preferable that a portion of the second part-side to-be-engaged portion that is exposed in one of a pair of main surfaces of the second plate-shaped portion is engaged by one of the pair of the first part-side engaging portions, and a portion of the second part-side to-be-engaged portion that is exposed in the other of the pair of main surfaces of the second plate-shaped portion is engaged by the other of the pair of the first part-side engaging portions.

In the last according to an aspect of the present disclosure, a plurality of the first part-side engaging portions may be provided to extend in the extending direction of the first part-side slit, and a plurality of the second part-side to-be-engaged portions may be provided to extend in a direction in which the second plate-shaped portion is inserted into the first part-side slit. In this case, it is preferable that the plurality of the second part-side to-be-engaged portions are engaged by the plurality of the first part-side engaging portions.

In the last according to an aspect of the present disclosure, the first part may be formed of a wooden board including only the first plate-shaped portion, and the second part may be formed of a wooden board including only the second plate-shaped portion. In this case, an end surface of each of the first plate-shaped portion and the second plate-shaped portion may define the forming surface.

The last according to an aspect of the present disclosure may include a plurality of the first parts and a plurality of the second parts. In this case, the plurality of the first parts and the plurality of the second parts may be mutually assembled.

In the last according to an aspect of the present disclosure, the first part may be formed of, in addition to the first plate-shaped portion, a block made of resin and having a portion defining at least a part of a bottom surface of the last, and the second part may be formed of a wooden board including only the second plate-shaped portion. In this case, the end surface of the second plate-shaped portion may define the forming surface.

The last according to an aspect of the present disclosure may include a plurality of the second parts. In this case, when a plurality of the first part-side to-be-engaged portions are provided to extend in a direction intersecting with a direction in which the first plate-shaped portion is inserted into the second part-side slit and in a direction intersecting with a main surface of the second plate-shaped portion, the plurality of the second parts arranged in a multilayered manner may be assembled into the first part.

In the last according to an aspect of the present disclosure, the first part may be formed of a wooden board including only the first plate-shaped portion, and the second part may be formed of a block made of resin and having a portion defining at least a part of a bottom surface of the last. In this case, an end surface of the first plate-shaped portion may define the forming surface.

The last according to an aspect of the present disclosure may include a plurality of the first parts. In this case, when a plurality of the second part-side receiving portions are provided to extend in a direction intersecting with a direction in which the first plate-shaped portion is inserted into the second part-side receiving portion and in a direction intersecting with the main surface of the first plate-shaped portion, the plurality of the first parts arranged in a multilayered manner may be assembled into the second part.

In addition, each of the lasts according to the above-described embodiments and the modifications thereof can be used as a shoe keeper after forming of the upper completes. In that case, the forming surface of the last is to function as a retaining surface that retains the shape of a shoe. Of course, the product having the configuration shown in any of the above-described embodiments and the modifications thereof may also originally be used as a shoe keeper instead of a last. The product applied as a shoe keeper has a characteristic configuration as follows.

The shoe keeper is formed by combining a plurality of last forming parts that are detachable, and is inserted into a shoe and thus capable of keeping the shape of the shoe. The plurality of last forming parts include a first part and a second part. At least one of the first part and the second part defines a retaining surface for retaining the shape of a shoe. The first part includes a first plate-shaped portion, and the second part includes a second part-side receiving portion having a cutout shape. The first part and the second part are assembled when the first plate-shaped portion is received in the second part-side receiving portion. The second part includes a second part-side engaging portion having a protruding shape on an inner side surface in a portion defining the second part-side receiving portion, and a main surface of the first plate-shaped portion is provided with a first part-side to-be-engaged portion having a through hole shape or a recessed shape. In the shoe keeper, when the first plate-shaped portion is inserted into the second part-side receiving portion, the first plate-shaped portion is fitted into the second part-side receiving portion, and further, the first part-side to-be-engaged portion is engaged by the second part-side engaging portion.

Other Embodiments

The above embodiments and the modifications thereof have been described with reference to an example in which the present invention is applied to a last fabricated through the process of: photographing a wearer's foot to obtain image data; producing a last model dedicated to the wearer based on the image data; and fabricating a plurality of plate-shaped parts based on the last model. However, the present invention does not necessarily have to be applied only to such a last, but may also be naturally applicable to a last fabricated through a different process. For example, the present invention is applicable not to a last dedicated to a wearer but also to a last fabricated by a conventionally known method.

Further, in the above-described embodiments and the modifications thereof, as a shoe manufactured using the last to which the present invention is applied, a shoe whose upper is fabricated using an upper forming material having heat shrinkability has been exemplified. However, the shoe manufactured using the last to which the present invention is applied is not limited to such a shoe but may be any type of shoe. In other words, the last to which the present invention is applied can be used also in manufacturing any type of shoe having a conventionally known configuration.

Further, the allocation of parts (i.e., for example, as to where each part (including a plate-shaped part and a block-shaped part) is laid out in the last) in the last disclosed in each of the above-described embodiments and the modifications thereof can of course be variously changed. In other words, the number of parts, the size of each of the parts, the arrangement position of the parts, the method of combining the parts, and the like in the last disclosed in each of the above-described embodiments and the modifications thereof are provided merely by way of example.

Further, the assembly sections (i.e., a receiving portion having a slit shape, an engaging portion having a protruding shape, a to-be-engaged portion having a through hole shape or a recessed shaped, and the like) disclosed in each of the above-described embodiments and the modifications thereof can be variously changed in number, size, shape, position of formation, and the like.

In addition, the characteristic configurations disclosed in the above-described embodiments and the modifications thereof can be combined with each other without departing from the gist of the present invention.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A last for forming a shoe upper, the last comprising:

a plurality of last forming parts that are detachable, wherein the last forming parts include a first part and a second part, at least one of the first part and the second part defines a forming surface for forming the shoe upper, the first part includes a first plate-shaped portion, the second part includes a second part-side receiving portion having a cutout shape, when the first plate-shaped portion is received in the second part-side receiving portion, the first part and the second part are assembled, the second part includes a second part-side engaging portion having a protruding shape on an inner side surface in a portion defining the second part-side receiving portion, the first plate-shaped portion has a main surface with a first part-side to-be-engaged portion having a through hole shape or a recessed shape, when the first plate-shaped portion is inserted into the second part-side receiving portion, the first plate-shaped portion is fitted into the second part-side receiving portion, and the first part-side to-be-engaged portion is engaged by the second part-side engaging portion.

2. The last according to claim 1, wherein the second part includes a second plate-shaped portion, the second part-side receiving portion includes a second part-side slit in the second plate-shaped portion to reach an end surface of the second plate-shaped portion, and the first plate-shaped portion and the second plate-shaped portion are assembled to intersect with each other.

3. The last according to claim 2, wherein a pair of the second part-side engaging portions are configured to face each other in a direction intersecting with an extending direction of the second part-side slit, the first part-side to-be-engaged portion has a through hole shape, a portion of the first part-side to-be-engaged portion that is exposed in one of a pair of main surfaces of the first plate-shaped portion is engaged by one of the pair of the second part-side engaging portions, and a portion of the first part-side to-be-engaged portion that is exposed in the other of the pair of main surfaces of the first plate-shaped portion is engaged by the other of the pair of the second part-side engaging portions.

4. The last according to claim 2, wherein a plurality of the second part-side engaging portions are configured to extend in an extending direction of the second part-side slit, a plurality of the first part-side to-be-engaged portions are configured to extend in a direction in which the first plate-shaped portion is inserted into the second part-side slit, and the plurality of the first part-side to-be-engaged portions are engaged by the plurality of the second part-side engaging portions.

5. The last according to claim 2, wherein the first part includes a first part-side receiving portion having a cutout shape, the first part-side receiving portion is configured of a first part-side slit in the first plate-shaped portion to reach an end surface of the first plate-shaped portion, the first part-side to-be-engaged portion is at a position on a line extending in an extending direction of the first part-side slit, and when the second plate-shaped portion is inserted into the first part-side slit, the second plate-shaped portion is fitted into the first part-side slit.

6. The last according to claim 5, wherein the first plate-shaped portion includes a first part-side engaging portion having a protruding shape on an inner side surface in a portion defining the first part-side slit, a second part-side to-be-engaged portion having a through hole shape or a recessed shape is on a main surface of the second plate-shaped portion, the second part-side to-be-engaged portion is at a position on a line extending in an extending direction of the second part-side slit, and the second part-side to-be-engaged portion is engaged by the first part-side engaging portion.

7. The last according to claim 6, wherein a pair of the first part-side engaging portions are configured to face each other in a direction intersecting with the extending direction of the first part-side slit, the second part-side to-be-engaged portion has a through hole shape, a portion of the second part-side to-be-engaged portion that is exposed in one of a pair of main surfaces of the second plate-shaped portion is engaged by one of the pair of the first part-side engaging portions, and a portion of the second part-side to-be-engaged portion that is exposed in the other of the pair of main surfaces of the second plate-shaped portion is engaged by the other of the pair of the first part-side engaging portions.

8. The last according to claim 6, wherein a plurality of the first part-side engaging portions are configured to extend in the extending direction of the first part-side slit, a plurality of the second part-side to-be-engaged portions are configured to extend in a direction in which the second plate-shaped portion is inserted into the first part-side slit, and the plurality of the second part-side to-be-engaged portions are engaged by the plurality of the first part-side engaging portions.

9. The last according to claim 2, wherein the first part is configured of a wooden board including only the first plate-shaped portion, the second part is configured of a wooden board including only the second plate-shaped portion, and an end surface of each of the first plate-shaped portion and the second plate-shaped portion defines the forming surface.

10. The last according to claim 9, wherein the last includes a plurality of the first parts and a plurality of the second parts, and the plurality of the first parts and the plurality of the second parts are mutually assembled.

11. The last according to claim 2, wherein the first part is configured of, in addition to the first plate-shaped portion, a block made of resin and having a portion defining at least a part of a bottom surface of the last, the second part is configured of a wooden board including only the second plate-shaped portion, and the end surface of the second plate-shaped portion defines the forming surface.

12. The last according to claim 11, wherein the last includes a plurality of the second parts, and when a plurality of the first part-side to-be-engaged portions are configured to extend in a direction intersecting with a direction in which the first plate-shaped portion is inserted into the second part-side slit and in a direction intersecting with a main surface of the second plate-shaped portion, the plurality of the second parts arranged in a multilayered manner are assembled into the first part.

13. The last according to claim 1, wherein the first part is configured of a wooden board including only the first plate-shaped portion, the second part is configured of a block of resin and having a portion defining at least a part of a bottom surface of the last, and an end surface of the first plate-shaped portion defines the forming surface.

14. The last according to claim 13, wherein the last includes a plurality of the first parts, and when a plurality of the second part-side receiving portions are configured to extend in a direction intersecting with a direction in which the first plate-shaped portion is inserted into the second part-side receiving portion and in a direction intersecting with the main surface of the first plate-shaped portion, the plurality of the first parts arranged in a multilayered manner are assembled into the second part.

* * * * *